US005520229A

United States Patent [19]

Yamada

[11] Patent Number: 5,520,229

[45] Date of Patent: May 28, 1996

[54] DEVELOPER REPLENISHING CARTRIDGE AND DEVELOPER RECEIVING APPARATUS WITHIN WHICH SUCH CARTRIDGE IS MOUNTED

[75] Inventor: Yoshihiko Yamada, Kawasaki, Japan

[73] Assignee: Canon Kabushiki Kaisha, Tokyo, Japan

[21] Appl. No.: 388,632

[22] Filed: Feb. 14, 1995

Related U.S. Application Data

[62] Division of Ser. No. 206,277, Mar. 7, 1994, which is a continuation of Ser. No. 881,881, May 12, 1992, abandoned.

[30] Foreign Application Priority Data

| | | | |
|---|---|---|---|
| May 14, 1991 | [JP] | Japan | 3-109233 |
| May 24, 1991 | [JP] | Japan | 3-120055 |
| May 24, 1991 | [JP] | Japan | 3-120056 |
| May 24, 1991 | [JP] | Japan | 3-120064 |
| Jul. 8, 1991 | [JP] | Japan | 3-167038 |

[51] Int. Cl.[6] ..... B65B 1/04

[52] U.S. Cl. ..... 141/364; 141/363; 355/260

[58] Field of Search ..... 141/364, 365, 141/366, 375, 383, 386, 363; 355/260; 222/DIG. 1

[56] References Cited

U.S. PATENT DOCUMENTS

| | | | |
|---|---|---|---|
| 4,142,655 | 3/1979 | Fantuzzo | 222/318 |
| 4,491,161 | 1/1991 | Tamura et al. | 141/364 |
| 4,589,579 | 5/1986 | Morita | 222/561 |
| 4,614,286 | 9/1986 | Yamaguchi et al. | 222/505 |
| 4,650,070 | 3/1987 | Oka et al. | 206/216 |
| 4,799,608 | 1/1989 | Oka | 222/505 |
| 4,834,246 | 5/1989 | Inoue et al. | 222/505 |
| 4,895,104 | 1/1990 | Yoshino et al. | 118/653 |
| 4,954,844 | 9/1990 | Morita et al. | 355/260 |
| 4,961,450 | 10/1990 | Furuta | 141/364 |
| 4,981,218 | 1/1991 | Ban et al. | 206/633 |
| 5,018,560 | 5/1991 | Tsukamoto | 141/364 |
| 5,040,024 | 8/1991 | Fukuda | 355/260 |
| 5,040,025 | 8/1991 | Fukuchi | 355/260 |
| 5,089,854 | 2/1992 | Kaieda et al. | 355/260 |
| 5,091,750 | 2/1992 | Yoshida | 355/260 |
| 5,153,650 | 10/1992 | Maeshima | 355/260 |
| 5,172,165 | 12/1992 | Hatakeyama et al. | 355/215 |
| 5,175,588 | 12/1992 | Katagata | 355/260 |
| 5,177,540 | 1/1993 | Honda et al. | 355/260 |
| 5,207,353 | 4/1993 | Corby et al. | 222/1 |
| 5,268,722 | 12/1993 | Ikkatai et al. | 355/260 |
| 5,351,728 | 10/1994 | Ban et al. | 141/364 |
| 5,363,177 | 11/1994 | Nakano et al. | 141/364 |

FOREIGN PATENT DOCUMENTS

| | | |
|---|---|---|
| 0102002 | 3/1984 | European Pat. Off. . |
| 57-38673 | 8/1982 | Japan . |
| 58-224364 | 12/1983 | Japan . |
| 59-57262 | 4/1984 | Japan . |
| 60-198567 | 10/1985 | Japan . |
| 60-154967 | 10/1985 | Japan . |
| 61-153054 | 9/1986 | Japan . |
| 63-178272 | 7/1988 | Japan . |
| 63-132962 | 8/1988 | Japan . |
| 63-249870 | 10/1988 | Japan . |
| 63-170851 | 11/1988 | Japan . |
| 171761 | 5/1989 | Japan . |
| 171762 | 5/1989 | Japan . |
| 1223483 | 9/1989 | Japan . |
| 3102371 | 4/1991 | Japan . |

OTHER PUBLICATIONS

European Search Report dated Jun. 22, 1993.
European Search Report dated Sep. 9, 1993.

*Primary Examiner*—David J. Walczak
*Attorney, Agent, or Firm*—Fitzpatrick, Cella, Harper & Scinto

[57] ABSTRACT

A developer supply opening of a developer replenishing cartridge is sealed by a flexible film peelably adhered to the cartridge, and one end of a folded back portion of the film is secured to a gripper which is manipulated by an operator and which is separably mounted on the cartridge. A developer receiving container on which the cartridge can be mounted has a lid. When the lid is opened, the lid engages by the gripper to separate the latter from the cartridge.

6 Claims, 19 Drawing Sheets

DEVELOPER REPLENISHING CARTRIDGE AND DEVELOPER RECEIVING APPARATUS WITHIN WHICH SUCH CARTRIDGE IS MOUNTED

This application is a division of application Ser. No. 08/206,277 filed Mar. 7, 1994, which is a continuation of prior application Ser. No. 07/881,881 filed May 12, 1992, now abandoned.

BACKGROUND OF THE INVENTION

1. Field of the Invention

The present invention relates to a developer receiving apparatus used with an image forming system such as an electrophotographic copying machine, electrophotographic printer and the like which can form an image by developing an electrostatic latent image by powder developer, and a developer replenishing cartridge removably mountable within the developer receiving apparatus.

2. Related Background Art

A developer replenishing cartridge wherein a flexible film is peelably adhered to a developer container to seal a developer supply opening of the container is disclosed in U.S. Pat. No. 4,981,218. When the developer is replenished in a developer receiving apparatus, the flexible film is peeled from the container.

In such an arrangement, if the film is peeled from the container before the cartridge is completely mounted within the developer receiving apparatus, it is feared that the developer is scattered around there. Further, in the above arrangement, it is necessary to open a developer passing opening (developer receiving opening) of the developer receiving apparatus before the cartirdge is mounted within the apparatus. However, if do so, it is feared that any foreign matters may drop into the apparatus through the opening.

The Japanese Utility Model Publication No. 57-38673 discloses a mechanism wherein sliding lids are provided on both a developer replenishing cartridge and on a developer receiving apparatus and the sliding lids are shifted in synchronous with each other.

U.S. Pat. No. 4,491,161 discloses a developer replenishing cartridge wherein a developer supply opening of the cartridge is sealed by a flexible film and a slide lid. The developer supply opening of the cartridge is opened in synchronous with the movement of a lid of a developer receiving apparatus. This arrangement not only provides the convenience similar to that of the Japanese Utility Model Publication No. 57-38673, but also provides the sealing ability superior to that of the Japanese Utility Model Publication No. 57-38673.

However, in this arrangement, when the lid of the developer receiving apparatus is being opened, the developer adhered to the film of the cartridge is likely to adhere to the lid. Further, it is feared that an operator removes the cartridge from the developer receiving apparatus before the lid of the developer receiving apparatus is completely closed. If do so, the apparatus will be damaged or the developer will be scattered around there. Further, if the developer is replenished into the developer receiving apparatus in which a substantial amount of developer still remains, the excessive amount of developer will be loaded in the developer receiving apparatus or the developer will overflow out of the developer receiving apparatus, thus making the closing of the lid difficult.

SUMMARY OF THE INVENTION

An object of the present invention is to provide a developer replenishing cartridge and a developer receiving apparatus, which can prevent the developer from being scattered around there.

Another object of the present invention is to provide a developer replenishing cartridge and a developer receiving apparatus, which have the easy operability.

The other objects and features of the present invention will be apparent from the following descriptions.

DESCRIPTION OF THE PREFERRED EMBODIMENTS

Figure 1:
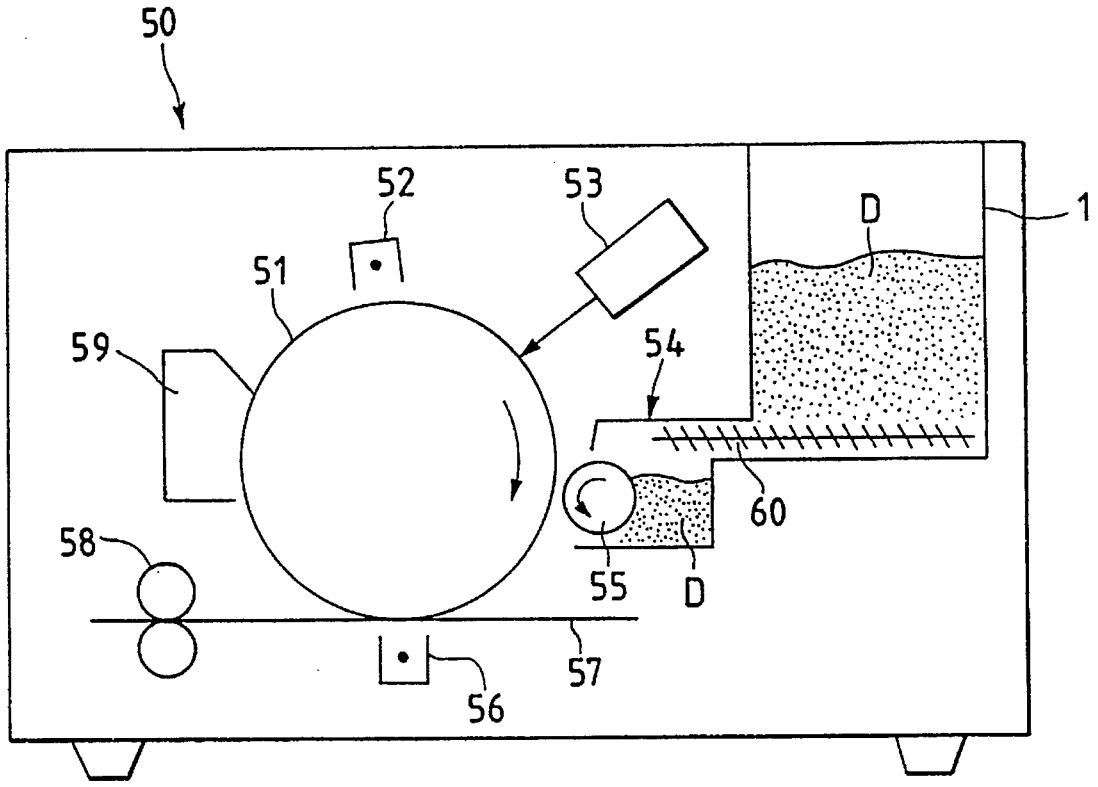
FIG. 1 is an elevational sectional view of an electrophotographic system to which the present invention is applicable.

In FIG. 1, an electrophotographic image forming system 50 includes an electrophotographic photosensitive member 51 rotated in a direction shown by the arrow. The photosensitive member 51 is firstly charged by a charger 52 and then is illuminated with recording image light by an exposure device 53, thereby forming an electrostatic latent image on the photosensitive member. The electrostatic latent image is developed by a developing unit 54. The developing unit 54 has a developing roller 55 which is rotated in a direction shown by the arrow and by which developer D is fed to and applied onto the electrostatic latent image.

A developer image so formed is transferred onto a transfer sheet 57 by means of a transfer charger 56 and then is permanently fixed to the transfer sheet 57 by means of a fixing device 58. After the transferring operation, the photosensitive member 51 is cleaned by a cleaning device 59.

In order to compensate for the developer consumed by the developing unit 54, the developer D is supplied to the developing unit 54 from the developer storage container (hopper) 1 of a developer receiving apparatus via a convey device 60 such as a screw conveyor. When an amount of the developer D in the container 1 is decreased below a permissible amount, an operator must replenish new developer from a developer replenishing cartridge into the container 1.

Next, the developer replenishing cartridge and the developer receiving apparatus will be fully explained.

Figure 2:
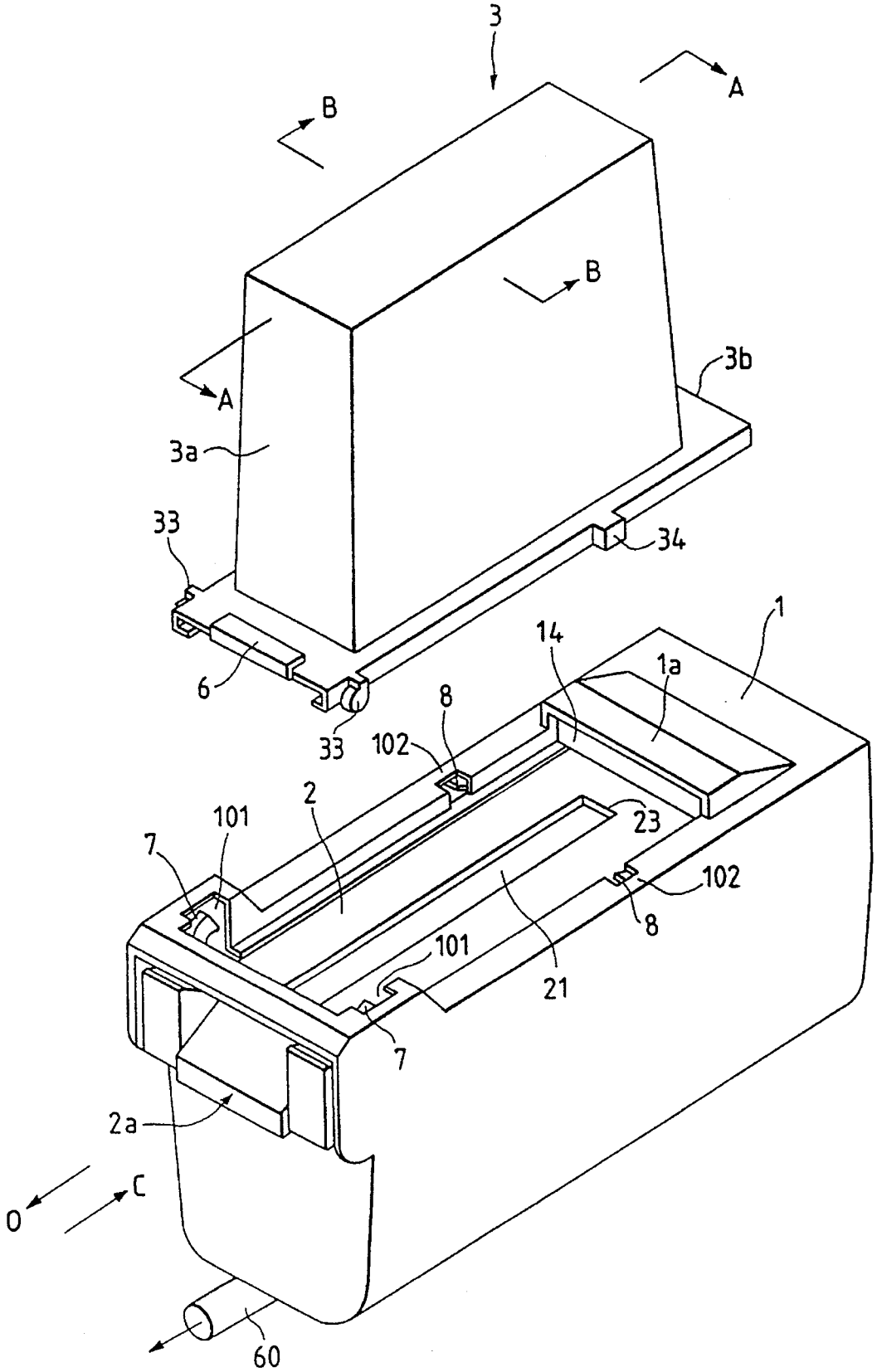
FIG. 2 is a perspective view showing a developer replenishing cartridge and a developer receiving container.
Figure 3:
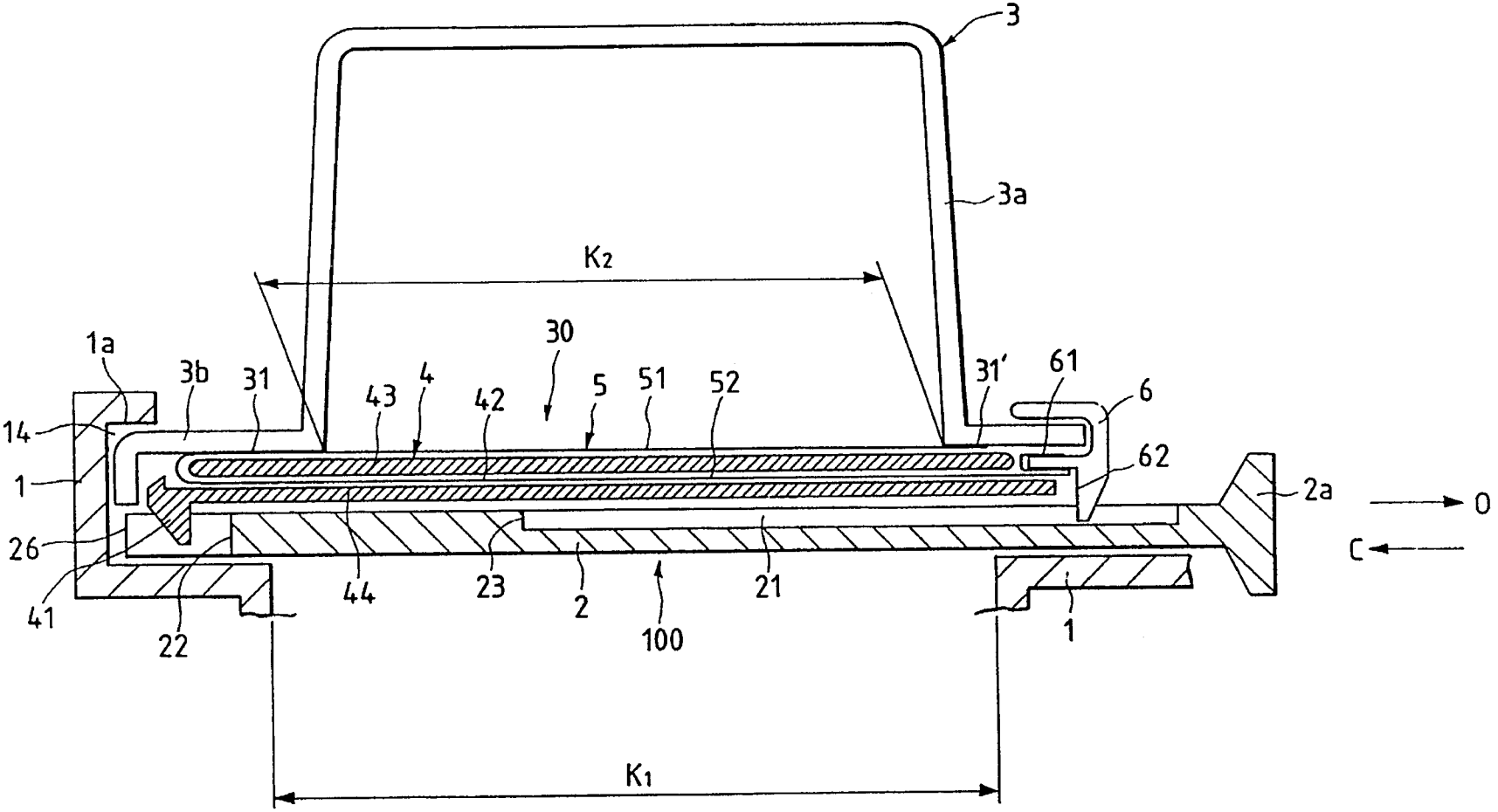
FIG. 3 is a sectional view taken along the line A—A of FIG. 2 showing the cartridge mounted on the container in place.
Figure 4:
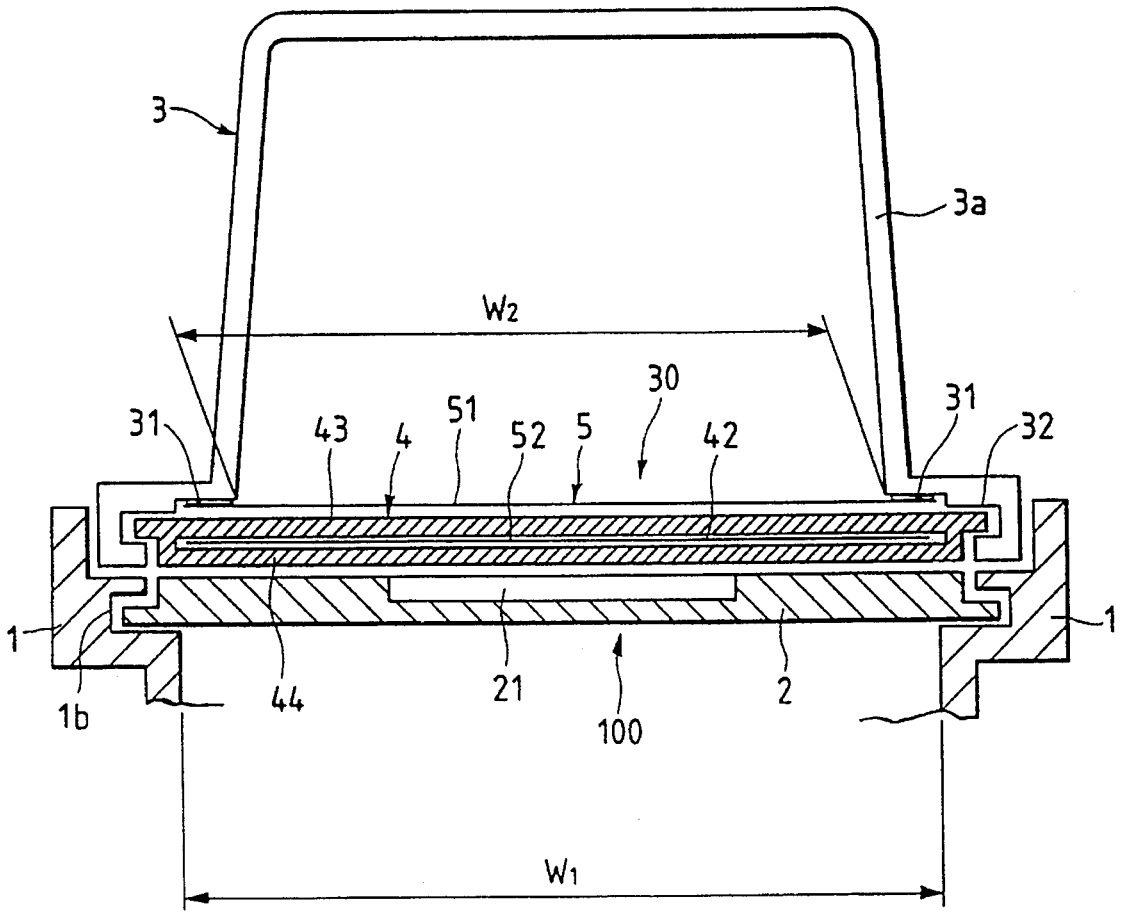
FIG. 4 is a sectional view taken along the line B—B of FIG. 2 showing the cartridge mounted on the container in place.

In FIGS. 2, 3 and 4, an upper opening 100 of the container 1 (i.e., an opening 100 through which the developer discharged from a developer replenishing cartridge 3 can drop into the container 1) is closed and opened by a lid 2 supported by guide grooves 1*b* formed in flange portions of the container 1 for sliding movement in a direction shown by the arrow O and an opposite direction shown by the arrow C. Further, on an upper surface of the container 1, there are formed a recessed portion 14 for receiving a protruded portion 3*b* of the cartridge 3, and a guide 1*a* for guiding the insertion of the protruded portion into the recessed portion. Incidentally, an elongated slot 21 extending in the sliding direction is formed on an upper surface of the lid 2.

On the other hand, a proper amount of replenishing developer D is housed in a container 3*a* of the developer replenishing cartridge 3, and a developer supply opening 30 of the cartridge is covered or closed by a slide lid 4 slidably guided by guide grooves 32 formed in flange portions of the container 3*a* for movement in the direction O and the opposite direction C. Incidentally, a projection 41 is formed on the slide lid 4 at an end of the lid in a push-in (slide closing) direction C, which projection is adapted to be hooked by an end portion 22 (in the push-in or slide closing direction C) of the lid 2. Further, a thin cavity 42 having openings on both ends thereof (in the sliding direction) is formed in the slide lid 4. That is to say, the slide lid 4 integrally includes a first plate member 43 and a second opposed plate member 44 via the cavity 42.

Further, a film (flexible seal sheet) 5 made of synthetic resin and the like is peelably adhered, for example, by heat welding, to a peripheral edge surface 31 defining a lower opening of the container 3*a* in such a manner that the seal sheet can prevent the leak of the developer D. When the seal sheet 5 is developed in the sliding direction, a total length of the sheet is selected to have a value greater, by twice or more, than a length of the supply opening 30 along a sheet peeling direction. The remaining portion 52 of the sheet 5 which is not adhered to the peripheral edge surface 31 is folded back and is passed through the inner cavity 42 of the slide lid 4 and is firmly secured to a gripper 6 (which is grasped by the operator when he wants to peel the seal sheet from the opening) at a position 61 where the seal sheet 5 does not protrude from the cartridge 3.

That is to say, the first sheet portion 51 adhered to the peripheral edge surface 31, 31' seals the supply opening 30 to prevent the leak of the developer in the container 3*a*. On the other hand, the second sheet portion 52 folded back toward the direction O is connected to the gripper 6 so that, when the second sheet portion 52 is pulled toward the direction C by pulling the gripper 6 (by the operator), the first sheet portion 51 is peeled from the peripheral edge surface 31 of the container 3*a*, thus opening the supply opening 30. Incidentally, the rear end portion 31' (in the peeling direction) of the sheet is not separated from the container 3*a*.

The sheet pulling gripper 6 can be pulled out by the shifting movement of the lid 2 and is fixed to the flange portions of the container 3*a*, for example, by pinching, clipping or meshing means before the cartridge 3 is mounted on the container 1. Further, the gripper 6 has a projection 62 which is adapted to engage by a rear end 23 (in a pull-out or slide opening direction O) of the elongated slot 21 of the lid 2 to disengage or pull out the gripper from the container 3*a*.

In this way, although the gripper 6 is disengaged from the container 3*a* by engaging with the rear end wall 23 immediately before the sliding of the lid 2 in the direction O is completed, the length of the second sheet portion 52 is selected so that the shock caused when the gripper 6 is disengaged from the container 3*a* by the shifting movement of the lid 2 is not transmitted to the first sheet portion 51. That is to say, the second sheet portion 52 has the surplus length, and, when the gripper 6 is attached to the container 3*a*, the surplus length of the second sheet portion 52 is housed within the cavity in the slide lid 4 in the folded condition not to protrude from the cartridge 3.

By the way, as shown in FIGS. 3 and 4, it is desirable that the dimensional relation between the supply opening 30 of the developer replenishing cartridge 3 and the opening 100 of the developer receiving container 1 is so selected that a dimension $K_1$ is greater than a dimension $K_2$ and a dimension $W_1$ is greater than a dimension $W_2$, that is, the opening 100 of the developer receiving container 1 is sufficiently greater than the supply opening 30 of the cartridge 3, because the guide grooves for the lid 4 of the container 3*a* and the lid 2 of the developer receiving container 1 are prevented from being smeared by the scattered developer when the developer is supplied from the cartridge to the developer receiving container.

Further, preferably, the peripheral edge surface 31 of the container 3*a* to which the seal sheet 5 is adhered has a step with respect to a sliding plane 32 for the slide lid 4 not to squeeze or compress the seal sheet 5 for permitting the smooth movement of the sheet.

Next, the opening/closing of the supply opening 30 of the cartridge 3 and the developer passing opening 100 of the container 1 will be explained with reference to FIGS. 5 to 8.

In a condition, as shown in FIG. 3, that the developer replenishing cartridge 3 is mounted on the developer receiving apparatus in place, i.e., in a condition that the lid 2 is opposed to the slide lid 4, the operator pulls the lid 2 in the direction O via a grip 2*a* of the lid 2. As a result, the opening 100 of the developer receiving apparatus is opened.

Figure 5:
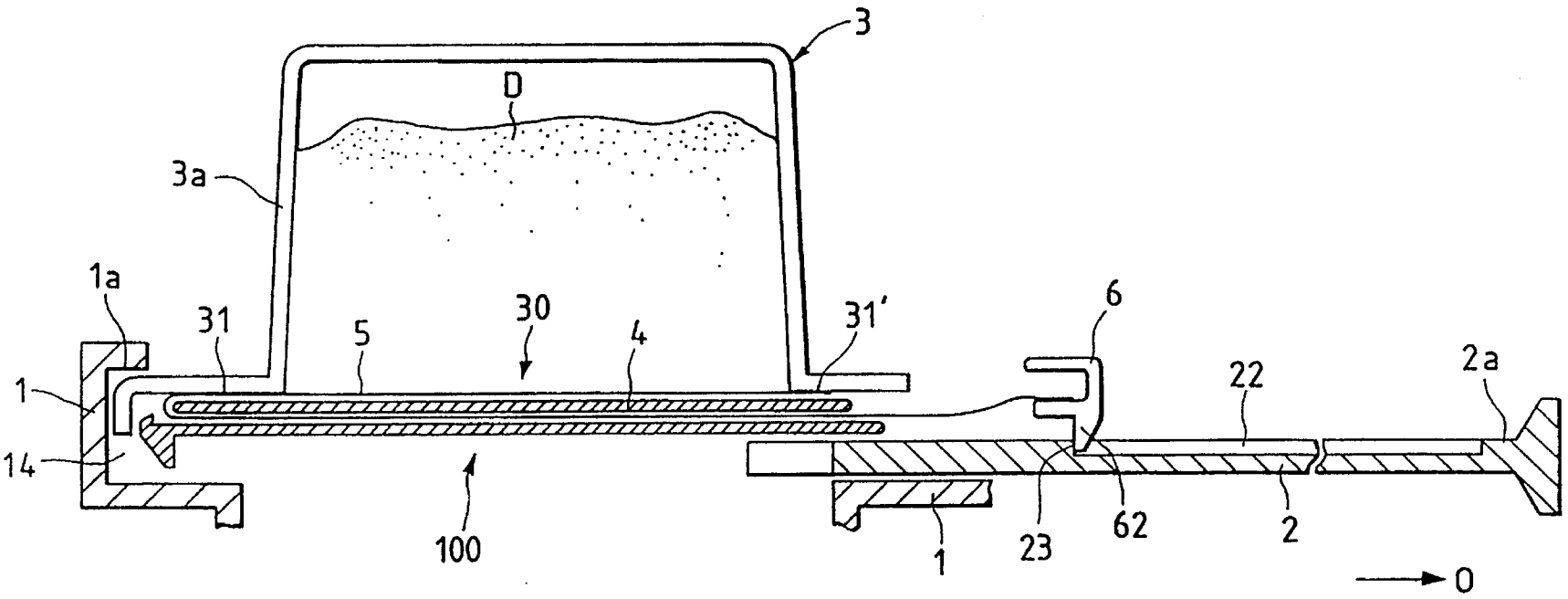
FIG. 5 is a sectional view showing a condition that a lid of the developer receiving container is opened.

Immediately before the lid 2 opens the opening 100 of the developer receiving container 1 completely, the rear end wall 23 of the elongated slot 21 formed in the lid 2 is engaged by the projection 62 of the sheet pulling gripper 6, thus starting the disengagement of the gripper 6 from the container 3*a* through the shifting movement of the lid 2 in the direction O. When the lid 2 opens the opening 100 completely, as shown in FIG. 5, the gripper 6 is disengaged from the container 3*a*, with the result that the operator can easily pull the gripper.

In this condition, the supply opening 30 of the container 3*a* is still closed, and, thus, the developer is not yet supplied to the container 1.

Figure 6:
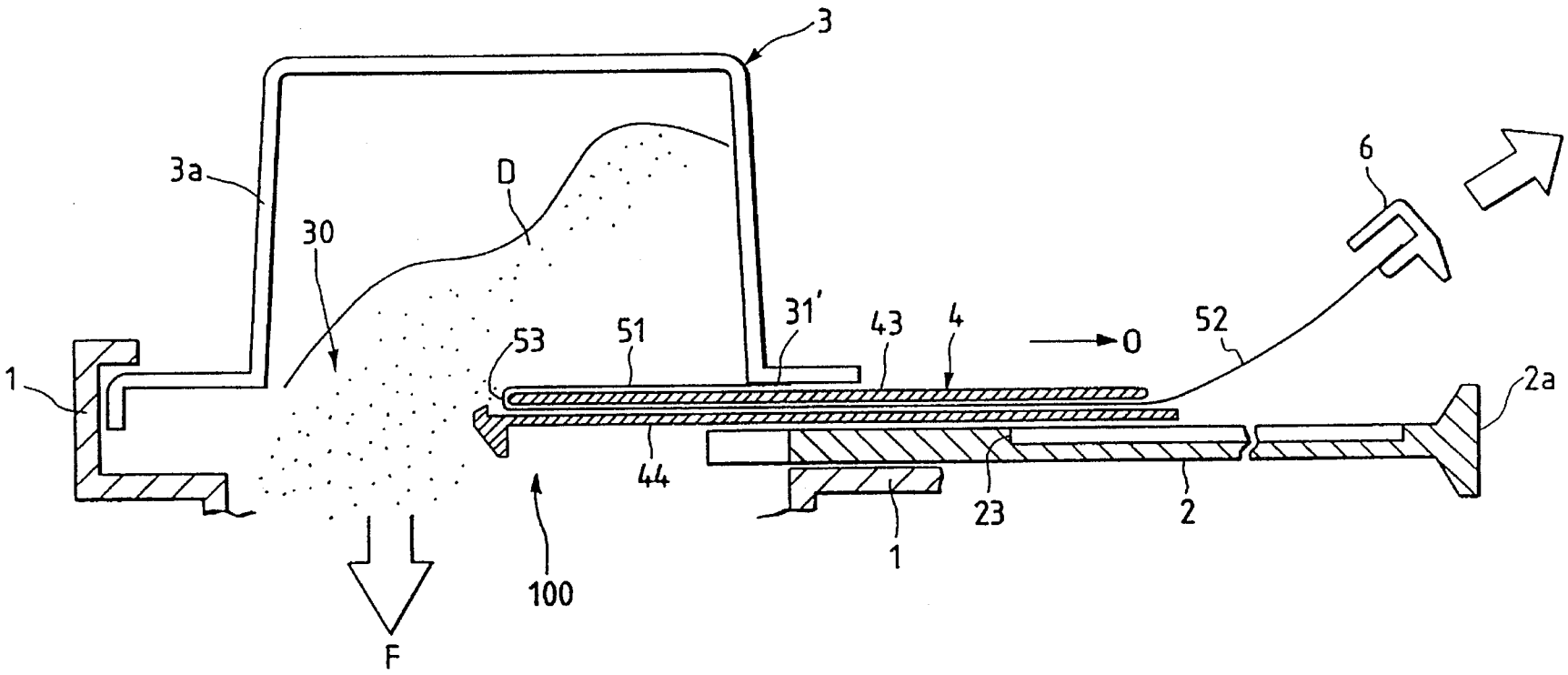
FIG. 6 is a sectional view showing a condition that a seal sheet of the developer replenishing cartridge is being removed.

Then, from this condition, when the operator pulls the seal sheet 5 in a direction shown by the arrow in FIG. 6 via the gripper 6, the seal sheet is shifted in the direction O within the cavity 42 while being guided by the plate members 43, 44 of the slide lid 4, with the result that the portion of the sheet 5 adhered to the peripheral edge surface 31 of the container 3*a* is gradually peeled from the folded position along the direction O. In this way, the folded position is gradually shifted in the direction O, as shown in FIG. 6. At the folded position 53, since the seal sheet 5 is engaged by a portion of the slide lid 4 (more particuarly, a rear end of the plate member 43 in the direction O, or a leading end in the direction C), according to the principle of a so-called "dynamic pulley block", the slide lid 4 is urged by the sheet 5 to be shifted in the direction O together with the second sheet portion 52.

In this way, the supply opening 30 of the container 3*a* begins to be opened, and the developer D starts to be dropped from the cartridge container 3*a* into the developer receiving container 1, as shown by the arrow F.

Figure 7:
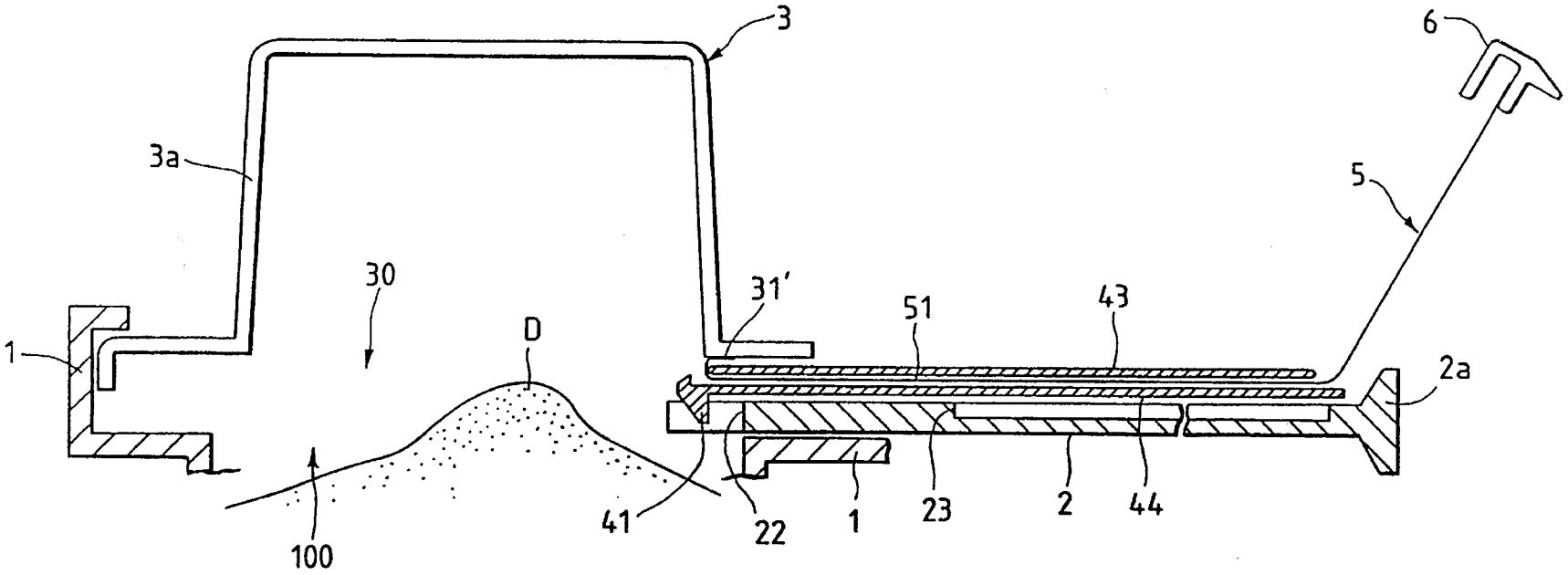
FIG. 7 is a sectional view showing a condition that the removal of the seal sheet is completed.

FIG. 7 shows a condition that the supply opening 30 of the cartridge container 3*a* is completely opened. In this condition, the slide lid 4 is opposed to the lid 2 again. Incidentally, in this case, the seal sheet 5 is still secured to the container 3*a* at the position 31', and the sheet 5 is not completely separated from the container 3*a*.

When the replenishment of the developer into the developer receiving container 1 is completed, the operator pushes the grip 2*a* of the lid 2 toward the direction C. Consequently, the lid 2 is shifted toward the direction C to close the opening 100. Immediately after the lid 2 starts to be slidingly shifted toward the direction C, an engagement portion 22 provided at an leading end (in the direction C) of the lid 2 is abutted against a projection 41 of the slide lid 4. As a result, the slide lid 4 is subjected to the shifting force from the lid 2 and starts to shift in the direction C together with the lid 2.

The seal sheet 5 remains to be secured to the container 3*a* at 31', and, since the sheet is engaged by the slide lid 4 at the folded position as mentioned above, when the slide lid 4 is shifted in the direction C, the sheet 5 is subjected to the shifting force from the slide lid 4 and starts to shift in a direction C opposite to the above-mentioned direction to start to close the opening 30 again. The sheet portion pulled out of the cavity 42 of the slide lid 4 starts to be re-entered into the cavity 42. In this way, the opening 30 of the container 3*a* is closed.

In this case, as shown in FIG. 7, even when the developer D protrudes from the opening 100, since the lids 2, 4 are engaged by each other at the leading ends thereof in the push-in or slide closing direction, the developer does not enter between the lids 2, 4 and is leveled by the lids.

Figure 9:
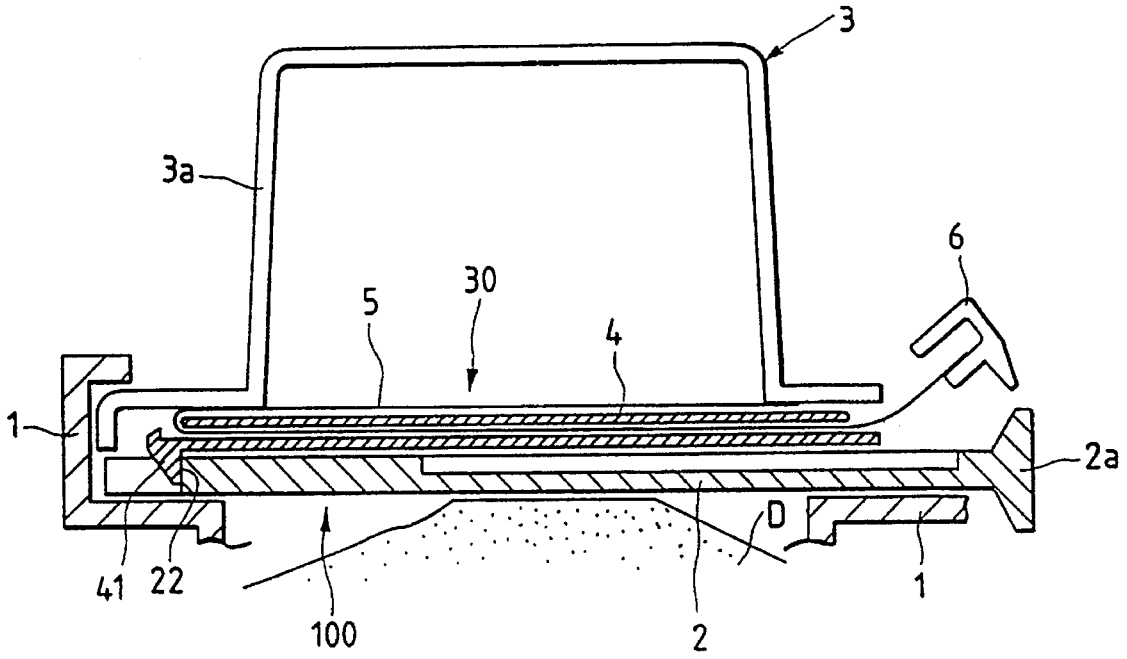
FIG. 9 is a sectional view showing a condition that the closing of the lid is completed.

When the opening 100 of the container 1 is completely closed by the lid 2 and the supply opening 30 of the container 3*a* is completely closed by the slide lid 4, as shown in FIG. 9, a part of the seal sheet 5 and the sheet pulling gripper 6 are maintained in a condition that they slightly protrude from the cartridge 3. In this condition, the lids 2, 4 are opposed to each other again.

As shown in FIG. 5, the operator is permitted to access the sheet pulling gripper 6 only when the opening 100 of the developer receiving container 1 and the gripper 6 is disengaged from the cartridge 3. Accordingly, it is possible to prevent the accident regarding the scattering of the developer caused when the cartridge is unsealed while closing the lid 2.

Figure 8:
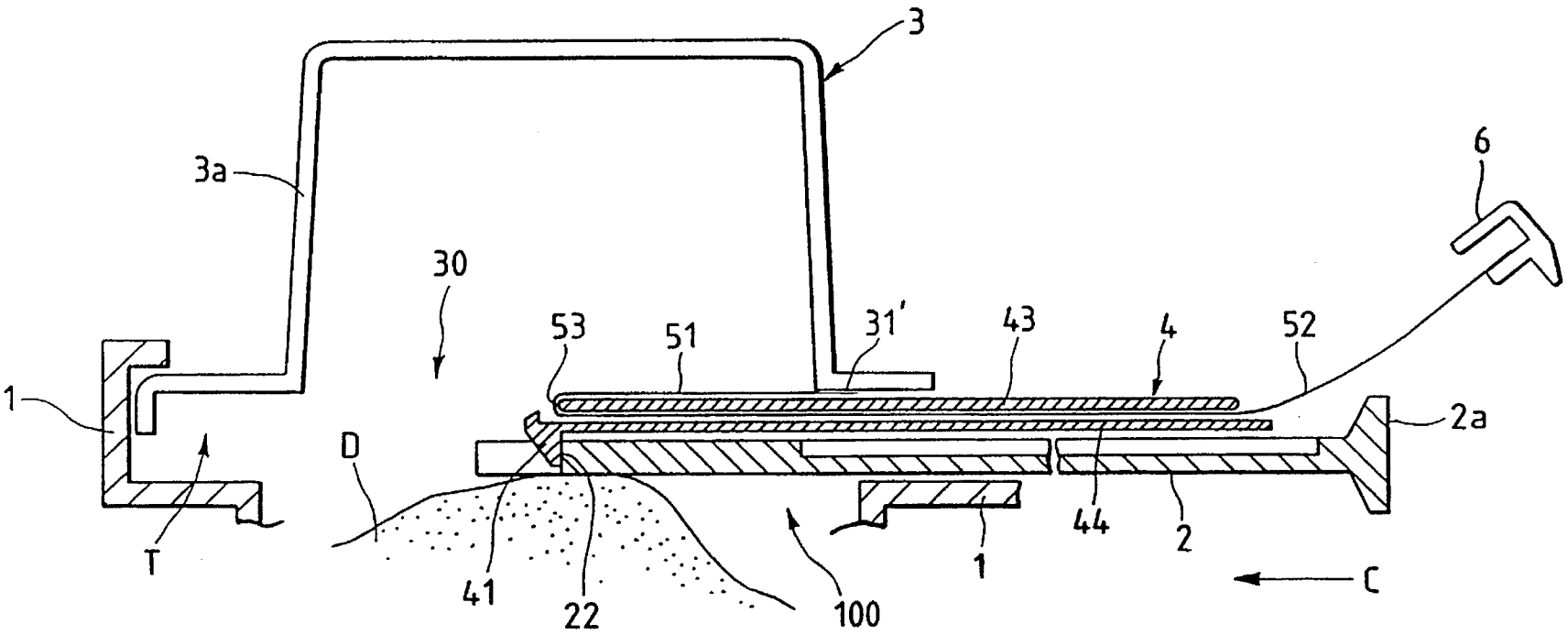
FIG. 8 is a sectional view showing a condition that the lid is being closed.

Further, as shown in FIG. 8, the slide lid 4 of the cartridge 3 is closed in synchronous with the closing movement of the lid 2 of the developer receiving apparatus. Accordingly, it is possible to prevent the accident regarding the scattering of the residual developer from the cartridge 3 as caused when the cartridge 3 is dismounted from the developer receiving apparatus while not closing the cartridge with the lid 4.

Further, since the seal sheet 5 of the cartridge 3 is protected by the slide lid 4, it is possible to prevent the accident regarding the scattering of the developer as caused when the sheet is teared or damaged.

Further, when the cartridge is opened or unsealed, since the first sheet portion 51 which was contacted with the developer in the container 3*a* is retracted into the cavity 42 of the slide lid 4, it is possible to prevent the scattering of the developer adhered to the first sheet portion 51. That is to say, when the sheet 5 is pulled out (FIG. 6), when the pulling of the sheet is completed (FIG. 7), when the sheet is retracted (FIG. 8) and when the retraction of the sheet is completed (FIG. 9), the upper surface (surface exposed out of the apparatus) of the lid 2 of the developer receiving container 1 is shielded from the sheet surface to which the developer is adhered, by the plate member 44 of the lid 4, whereby the upper surface of the lid 2 is not smeared by the developer adhered to the sheet surface. Further, in the conditions shown in FIGS. 6, 7 and 8, since the sheet portion to which the developer is adhered is covered by the plate member 43 of the lid 4 not to be exposed externally, even if the operator inadvertently accesses to such sheet portion, the operator is not smeared with the developer.

In addition, since the seal sheet 5 is not separated from the cartridge 3 completely and can be removed from the developer receiving apparatus together with the container 3*a* and the lid 4 after the cartridge container 3*a* is closed by the lid 4 and the sheet, the handling of the disused sheet can be facilitated.

Next, a locking mechanism will be explained.

When the developer is replenished into the developer receiving container 1, first of all, the developer replenishing cartridge 3 is mounted on the developer receiving container 1 in place, as shown in FIG. 3. That is to say, the cartridge container 3*a* is rested on the container 1 while inserting a protruded portion 3*b* of the container 3*a* into the recessed portion 14 of the container 1. The protruded portion 3*b* of the container 3*a* is regulated by the guide 1*a* so as not to shift upwardly. In this condition, the cartridge 3 can be pivoted around the protruded portion 3*b*.

Locking mechanisms 7 are provided on the developer receiving container 1 at position 101. Each locking mechanism 7 includes integral locking pawls 71, 73 which are pivotally mounted on a shaft 74 attached to the container 1. A leaf spring 9 urges a portion 72 of the pawl 71 upwardly so that the pawls 71, 73 are elastically biased toward an anti-clockwise direction.

Figure 10A:
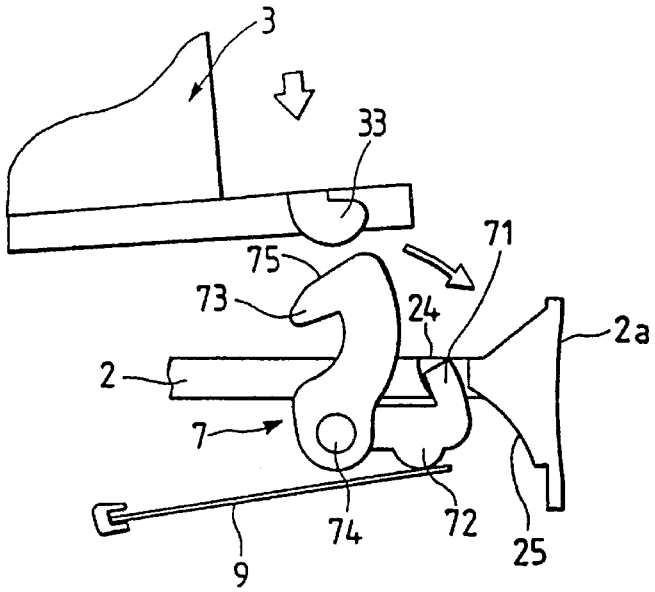
FIGS. 10A, 10B and 10C are views for explaining a locking mechanism.

When the cartridge 3 is not mounted on the container 1, as shown in FIG. 10A, the pawl 71 is fitted into a hole 24 of the lid 2 under the biasing force of the leaf spring 9, with the result that the sliding movement of the lid 2 is prevented and the lid 2 is locked at the position shown in FIG. 3. Accordingly, it is possible to prevent the accident regarding the penetration of foreign matters into the developer receiving container 1 as caused when the operator inadvertently opens the lid 2 before the cartridge 3 is mounted on the container 1.

As mentioned above, when the protruded portion 3*b* of the cartridge 3 is inserted into the recessed portion 14 of the container 1 and the cartridge 3 is lowered toward the upper surface of the container 1, projections 33 formed on the flange portions of the cartridge container 3*a* are abutted against cam surfaces 75 formed on upper surfaces of the locking pawls 73 of the locking mechanisms 7. In this condition, when the cartridge 3 is further lowered, each locking pawl 73 urged downwardly by the corresponding projection 33 is rotated in a clockwise direction in opposition to the biasing force of the corresponding leaf spring 9, with the result that the corresponding locking pawl 71 is also rotated in the clockwise direction together with the locking pawl 73.

Consequently, the locking pawl 71 is disengaged from the hole 24 of the lid 2 to permit the sliding movement of the lid 2. When the projection 33 passes through the cam surface 75, the locking pawl 73 is rotated in the anti-clockwise direction under the biasing force of the leaf spring 9 to engage by an upper surface of the projection 33 (refer to FIG. 10B). In this way, the cartridge 3 is locked at a predetermined position on the container 1, i.e., at a position where the developer is replenished from the cartridge into the container 1. The cartridge is prevented from being dismounted from the predetermined position. Since the anti-clockwise rotation of the locking pawl 71 is inhibited by the engagement of the locking pawl 73 with the projection 33, the unlocked condition of the lid 2 is maintained.

As mentioned above, since the cartridge 3 is locked at the predetermined position when the sliding movement of the lid 2 is permitted, it is possible to prevent the operator's miss-operation as to the inadvertent dismounting of the cartridge 3 from the developer receiving container 1 while opening the lid 2.

Figure 10B:
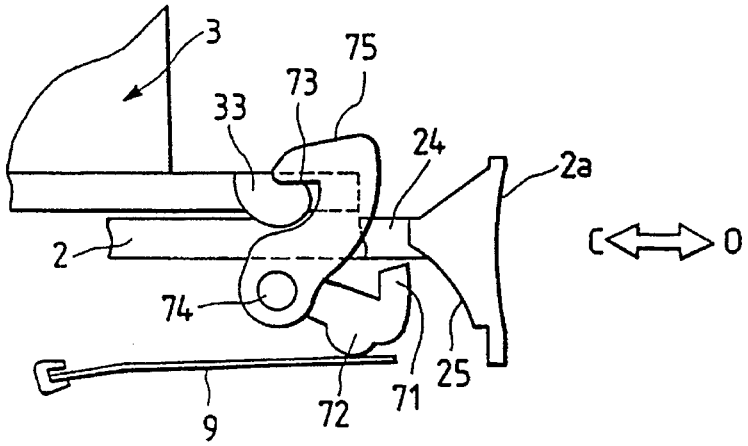

In the condition shown in FIG. 10B, the operations already described in connection with FIGS. 5 to 9 can be performed.

Figure 10C:
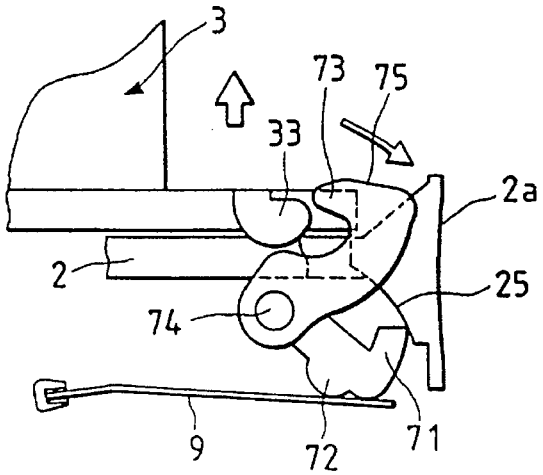

After the developer is replenished from the cartridge 3 into the container 1, the lid 2 is shifted or retracted in the direction C to reach the lid at a position slightly beyond the position shown in FIG. 3 where the opening 100 is completely closed. As a result, a cam surface 25 formed on an inner surface of the grip 2*a* of the lid 2 is abutted against the locking pawls 71. From this condition, when the lid 2 is further shifted to the direction C, each locking pawl 71 is urged by the cam surface 25 to be rotated in the clockwise direction in opposition to the biasing force of the corresponding leaf spring 9, thus rotating the corresponding integral locking pawl 73 in the clockwise direction. Consequently, as shown in FIG. 10C, the locking pawl 73 is disengaged from the projection 33 of the cartridge 3, thus unlocking the cartridge 3.

In this condition, the cartridge 3 is automatically pivoted around the protruded portion 3*b* and lifted by a biasing force of a spring 8 described below up to a position where, even when the locking pawl 73 is rotated in the anti-clockwise direction again, it cannot engage by the upper surface of the projection 33.

The operator can understand the fact that the cartridge 3 is unlocked, by ascertaining the automatic elevation of the cartridge 3. Accordingly, since the fact that the cartridge is dismountable can easily be judged, it is possible to prevent the operator's miss-operation as to the forcible dismounting of the cartridge 3 from the container 1.

On the other hand, after the operator recognizes the fact that the cartridge 3 is unlocked, when he releases the grip 2*a* of the lid 2 in the condition of FIG. 10C, the lid 2 moves as follows.

That is to say, the lid 2 is subjected to the biasing forces of the leaf springs 9 via the locking pawls 71 and the cam surface 25. Accordingly, when the locking pawls 71, 73 are rotated in the anti-clockwise direction under the biasing forces of the leaf springs 9, the lid 2 is automatically shifted in the direction O by the biasing forces of the springs. At a point where the lid 2 is slightly shifted to the direction O, the locking pawls 71 are re-entered into the corresponding holes 24 of the lid 2 under the biasing forces of the springs 9, thus restoring the condition shown in FIG. 10A. In the condition shown in FIG. 10A, the lid 2 is locked at the position shown in FIG. 3.

As mentioned above, since the cartridge 3 can be unlocked only when the lid 2 is further pushed beyond the locked position shown in FIG. 3 where the opening 100 of the container 1 is completely closed, and the lid 2 is automatically returned to the locked position after the unlocking of the cartridge, it is possible to prevent the cartridge from being dismounted from the developer receiving container in the condition that the opening of the developer receiving container is not completely closed.

In FIG. 2, two recesses 102 are formed in the container 1 between the front and rear ends of the opening 100 (in the sliding direction of the lid 2) and at both lateral sides of the opening 100. Leaf springs 8 are disposed in these recesses 102.

On the other hand, two projections 34 (only one of the which is shown) adapted to be inserted into the recesses 102 are formed on the flange portions of the cartridge container 3*a*.

Figure 11A:
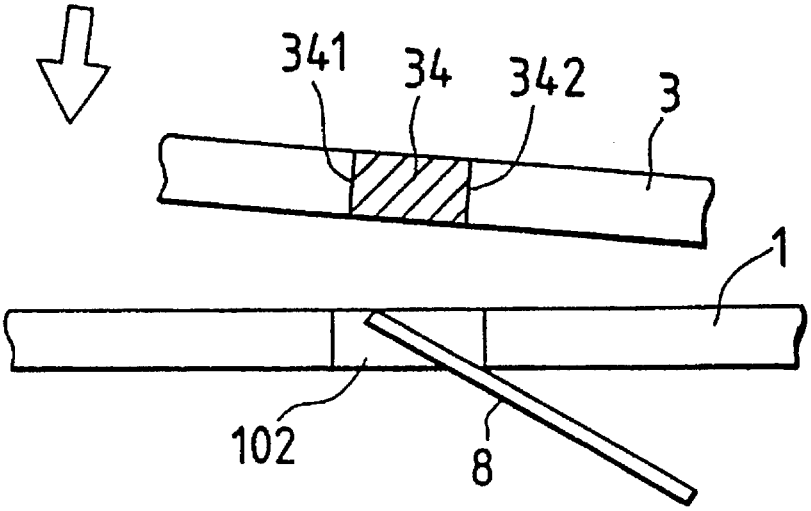
FIGS. 11A and 11B are views for explaining a cartridge lifting and rocking mechanism.
Figure 11B:
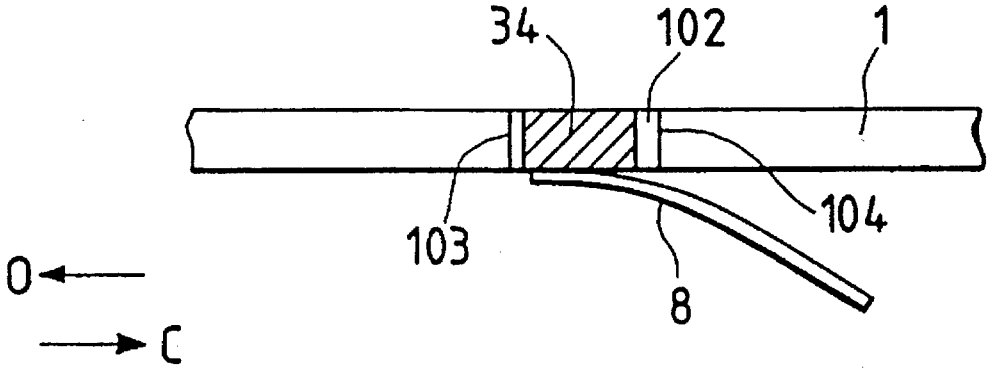

When the cartridge 3 is mounted on the container 1 as mentioned above, the projections 34 are fitted into the recesses 102 while abutting against the corresponding leaf springs 8. These leaf springs 8 apply the upward urging or biasing force to the cartridge 3 (see FIG. 11B).

The biasing force of the leaf springs 8 contributes to ensure the engagement between the locking pawls 73 and the projections 33 and serves to lift the cartridge 3 as mentioned above when the locking pawls 73 are disengaged from the projections 33.

On the other hand, as the lid 4 of the cartridge 3 is slidingly shifted in the direction O, when the cartridge 3 itself tries to shift in the direction O, one lateral surface 341 of the projection 34 is abutted against one lateral surface 103 of the corresponding recess 102, thus preventing the shifting of the cartridge 3 in the direction O. Further, as the lid 4 is slidingly shifted in the direction C, when the cartridge 3 itself tries to shift in the direction C, the other lateral surface 342 of the projection 34 is abutted against the other lateral surface 104 of the corresponding recess 102, thus preventing the shifting of the cartridge 3 in the direction C. That is to say, the projections 34 and the recesses 102 aid to the locking operation by means of the locking pawls 73. In other words, the projections 34 and the recesses 102 can prevent the inadvertent unlocking due to the excessive load applied to the locking mechanisms 7 during the opening/closing of the opening 30.

Further, the recesses 102 has the function to identify the cartridge. That is to say, only the cartridge having the projections 34 in correspondence to the recesses 102 can be mounted on the developer receiving container at the predetermined position. Accordingly, by differentiating the position of the projections 34 on the cartridge in correspondence to the kinds of developer, any cartridge containing the developer unnecessary to the specific image forming system cannot be mounted, at the predetermined position, on the developer receiving container for such image forming system, and, thus, it is possible to prevent the replenishment of the unnecessary or unsuited developer into the developer receiving container.

Incidentally, in the above example, while the leaf springs were abutted against the projections 34, the leaf springs may be abutted against the cartridge 3 at any portions other than the projections 34. Further, the projections may be formed on the container 1 and the recesses corresponding to such projections may be formed in the cartridge to achieve the same function as that obtained by the above-mentioned projections 34 and the recesses 120.

Figure 12A:
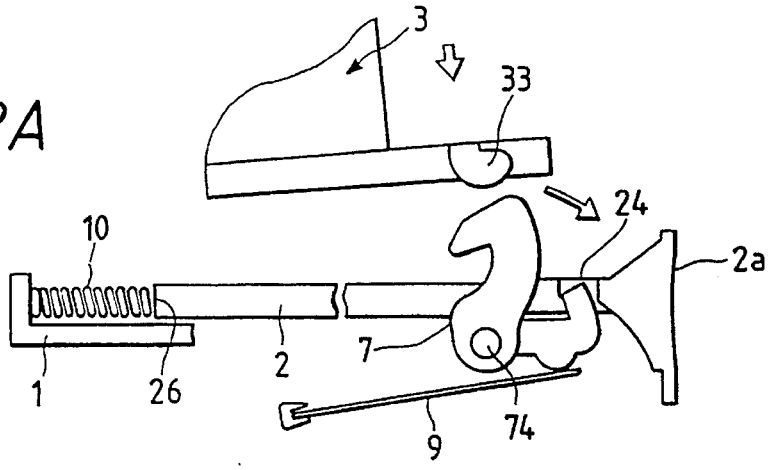
FIGS. 12A, 12B, 12C and 12D are views for explaining a slide biasing mechanism for the lid.
Figure 12B:
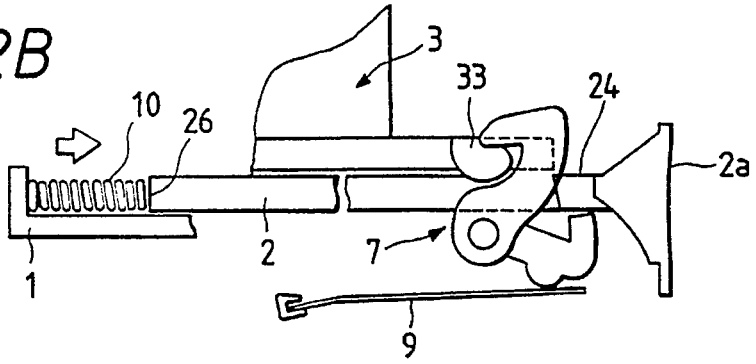
Figure 12C:
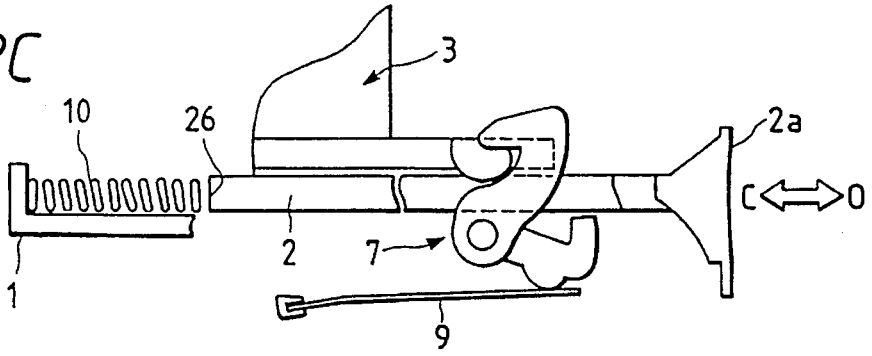
Figure 12D:
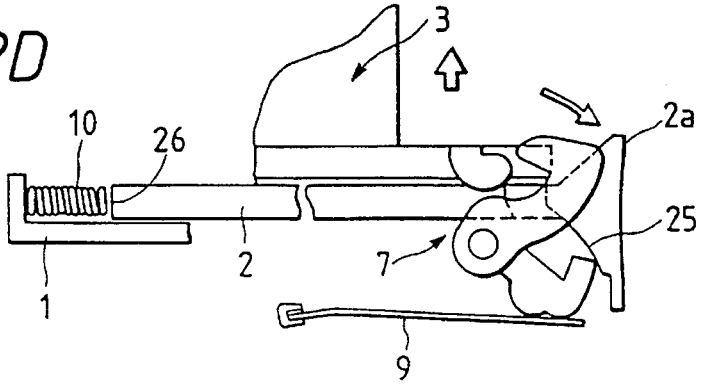

FIGS. 12A to 12D show another embodiment. In this embodiment, when the lid 2 is in a position shown in FIG. 12C and when the lid is in a position slightly offset from the position of FIG. 12C in a direction C, a spring 10 is abutted against a rear end 26 (in a direction O) of the lid 2 to elastically bias the lid 2 toward the direction O. FIGS. 12A, 12B and 12D correspond to FIGS. 10A, 10B and 10C, respectively.

In FIG. 12B, when the lid 2 is unlocked, the lid 2 is automatically shifted from the locked position toward the direction O slightly by the spring 10 (refer to FIG. 12C).

By such automatic shifting of the lid 2 in the pulling direction (direction O), the operator can understand the fact that the cartridge 3 is unlocked.

From the position of FIG. 12C, when the lid 2 is slidingly shifted in the direction O, the lid is separated from the spring 10.

In order to unlock the cartridge 3, the operator must shift the lid 2 in the direction C in opposition to the biasing force of the spring 10. However, when the lid 2 is automatically returned from the unlocked position for the cartridge 3 to the locked position for the lid 2 itself, the biasing force of the spring 10 aids such returning of the lid 2, as well as the biasing force of the springs 9.

Figure 13A:
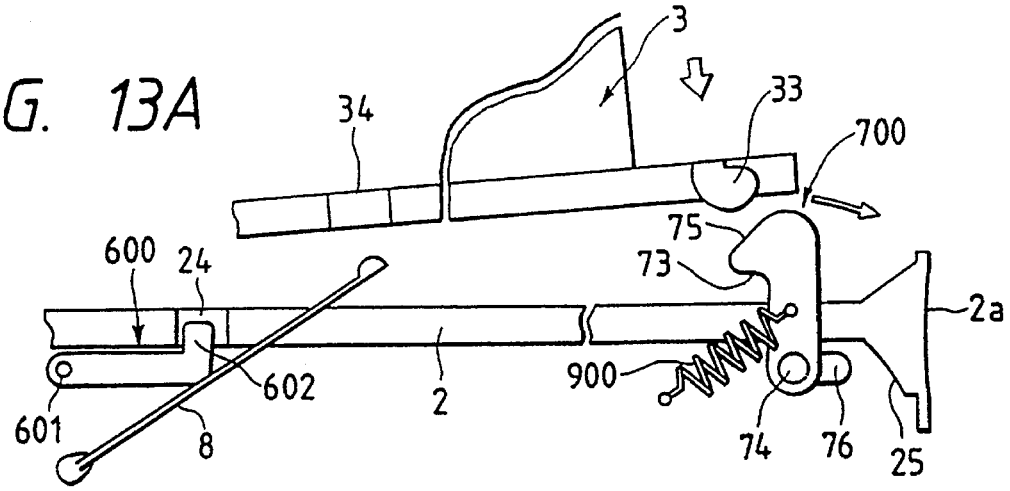
FIGS. 13A, 13B and 13C are views showing another example of a locking mechanism.
Figure 13B:
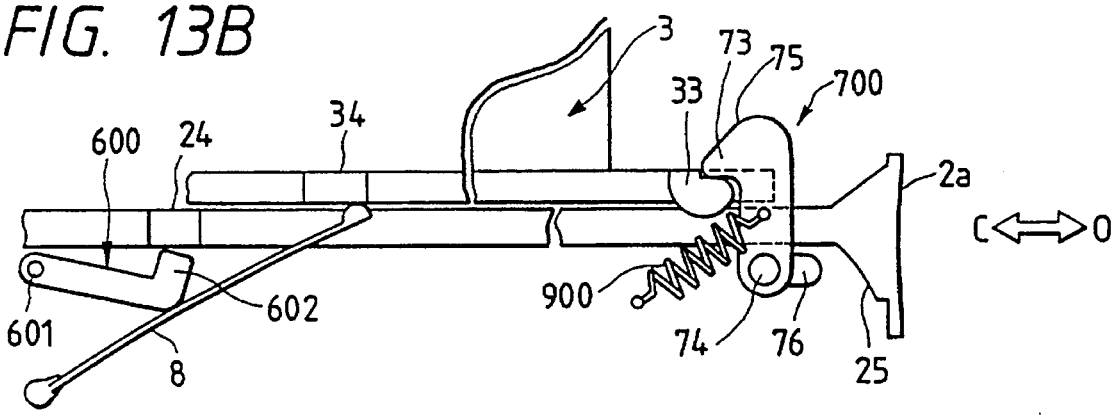
Figure 13C:
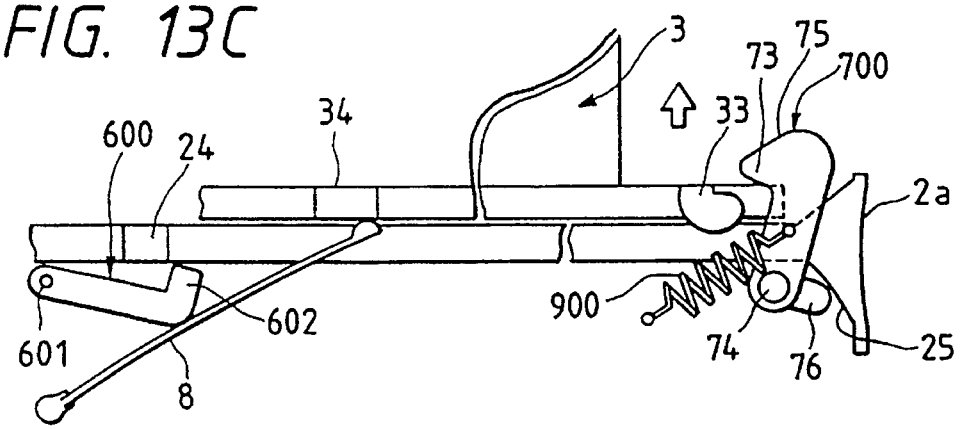

FIGS. 13A to 13C show another embodiment of a locking mechanism.

As shown in FIG. 13A, in a condition that the developer replenishing cartridge 3 is not mounted on the developer receiving apparatus, the lid 2 of the developer receiving container 1 is engaged by a locking pawl 602 of a locking mechanism 600 via a hole 24 formed in the lid itself, thus preventing the shifting movement of the lid.

The locking pawl 602 is pivotally mounted on a pivot pin 601 formed on the developer receiving container 1 and is always biased toward the hole 24 of the lid 2 by an elastic member (leaf spring) 8. Further, the locking pawl 602 itself may be constituted by an elastic member to omit the elastic member 8.

On the other hand, another locking mechanism 700 is arranged in the recess 101 of the lid 2. The locking mechanism 700 is similar to the above-mentioned locking mechanism 7, but, in place of the locking pawl 71, a cam engagement projection 76 is integrally formed on the locking pawl 73, and, in place of the leaf spring 9, a coil spring 900 is hooked to the locking pawl 73 to bias the locking pawl 73 and projection 76 in the anti-clockwise direction.

When the developer replenishing cartridge 3 is mounted as shown in FIG. 3, in the same manner as mentioned above, the projection 33 of the developer receiving container 1 rotates the locking pawl 73 in the clockwise direction. When the mounting of the cartridge is completed, as shown in FIG. 13B, the projection 33 is engaged by the locking pawl 73. This prevents the dismounting of the cartridge in cooperation with the protruded portion **3*b* of the cartridge 3 inserted into the recessed portion 14**.

As shown in FIG. 13B, in a condition that the developer replenishing cartridge 3 is mounted, by the projection 34 of the cartridge 3 fitted into the recess 102 of the container 1, the elastic member 8 is pressed down to disengage the locking pawl 602 from the hole 24, thus disengaging the locking pawl 602 from the lid 2 to permit the movement of the latter.

In this way, the developer is supplied from the cartridge into the container 1 as mentioned above. After the replenishment of the developer, the lid 2 is pushed to the position of FIG. 3. From this condition, as shown in FIG. 13C, when the lid 2 is further pushed toward the direction C, the cam surface 25 of the lid 2 urges the projection 76 integral with the locking pawl 73, thus rotating the locking pawl 73 in the clockwise direction in opposition to the coil spring 900. As a result, the locking pawl 73 is disengaged from the projection 33 of the cartridge 3. Consequently, the cartridge 3 is automatically lifted by the biasing force of the elastic member 8. In this condition, the cartridge 3 can be dismounted from the container 1 while retracting the protruded portion **3*b* from the recessed portion 14**.

Then, when the operator detaches his hand from the lid 2, the latter is returned to the pulling direction by the compressed coil spring 900 via the projection 76. Meanwhile, the locking pawl 602 biased toward the anti-clockwise direction by the elastic member 8 released from the projection 33 is re-entered into the hole 24 of the lid 2, thus stopping the lid 2. In this way, the lid 2 is returned to the position of FIG. 13A. Alternatively, from the position of FIG. 13C, the lid 2 may be manually pulled until the locking pawl 602 is re-entered into the hole 24 of the lid 2.

By the way, in a developer replenishing system wherein the lid of the developer receiving container is locked other than the replenishment of the developer, the operator cannot directly ascertain the residual amount of the developer with his eyes. Further, even when a sensor of piezo type is provided on the developer receiving container to detect the residual amount of the developer, it is feared that the developer is replenished even into the developer receiving container in which a relatively large amount of developer still remains due to the mal-function of the sensor or the operator's careless mistake, with the result that the amount of the replenished developer exceeds the maximum developer containing ability of the developer receiving container.

In such a case, the lid 2 must be closed while pushing a mountain of developer aside by the end projection 41 of the slide lid 4 to push the excessive developer back to the developer replenishing cartridge 3. The developer comprised of small particles has the good fluidity, but is likely to be lumped. Thus, when the lids 2, 4 are being closed, the developer is pressed together by the ends of the lids and is jammed at a portion T in FIG. 8, thus opposing to the closing movement of the lids 2, 4. As a result, it is feared that the developer replenishing cartridge 3 cannot be dismounted from the developer receiving container 1.

Accordingly, in this embodiment, the developer receiving container 1 is provided with a buffer chamber for receiving the excessive developer to eliminate the resistance to the closing movement of the lids 2, 4, thus ensuring that the slide lid 4 of the developer replenishing cartridge can be closed without fail.

Figure 14:
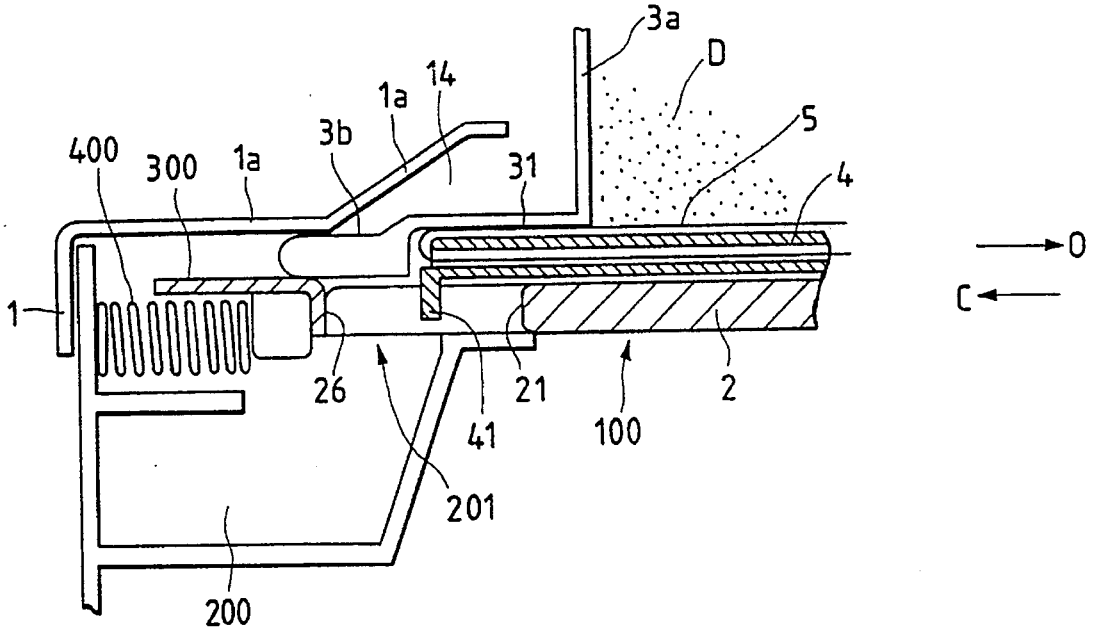
FIGS. 14, 15, 16 and 17 are sectional views showing an example of a buffer chamber.

The operation of the buffer chamber according to this embodiment will now be explained with reference to FIGS. 14 to 17. In FIG. 14, the developer receiving container 1 has a buffer chamber 200 disposed beside the opening 100 of the container 1 and adjacent to the front end (in the push-in direction C) of the lid 2 when the opening 100 is completely closed by the lid 2. The buffer chamber 200 has an excessive developer introducing opening 201 disposed in substantially the same plane as the opening 100 of the developer receiving container 1. The opening 201 is closed by a lid 300 biased toward a closing direction (opening direction O for the lids 2, 4) by means of an elastic member 400, in a condition that the developer replenishing cartridge 3 is not mounted on the developer receiving container 1.

In this embodiment, by the limitation of the dimension of the edge surface 31 to which the seal sheet 5 of the developer replenishing cartridge 3 is adhered ant of the developer supplying apparatus, when the developer replenishing cartridge 3 is mounted on the developer receiving container 1, the lid 300 is pushed and opened by the end portion 26 (in the closing direction) of the lid 2 in opposition to a biasing force of the elastic member (spring) 400. However, in such a condition, the lid 300 may remain to be closed.

When the protruded portion **3*b* of the developer replenshing cartridge 3 is inserted between the guide 1*a* of the developer receiving container 1 and the lid 300, the protruded portion 3*b* contacts the lid 300 with a strength not to disturb the sliding the lid 300, while the upward movement of the protruded portion being limited by the guide 1*a***.

Figure 15:
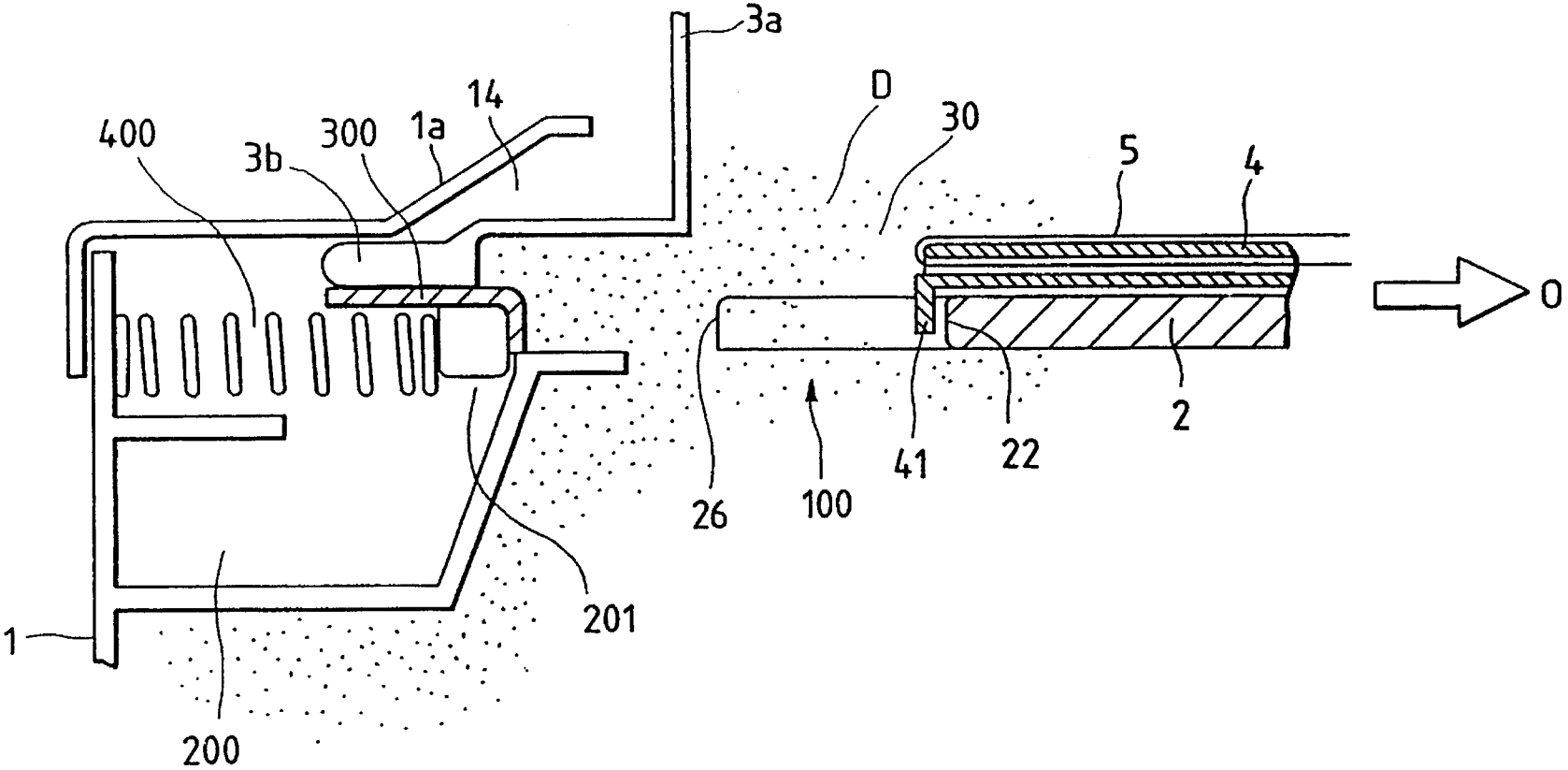

When the developer is supplied from the developer replenishing cartridge, since the lid 2 is shifted in the opening direction O to release the urging force (via the end portion 26) against the lid 300, as shown in FIG. 15, the lid 300 is urged in the closing direction by the elastic member 400 to close the opening 201 of the buffer chamber 200 with contacting with the lower surface of the protruded portion **3*b* of the developer replenishing container 3*a*. In this condition, the developer overflowed from the developer receiving container 1 does not enter into the buffer chamber 200 and remains in the developer replenishing container 3*a*. In this condition, when the lid 2 forcibly closed, the end face 22 of the lid 2 engages with the projection 41 of the lid 4 to push the lid 4, with the result that the lids 2, 4 are advanced while pushing the developer aside by the projection 41**.

Figure 16:
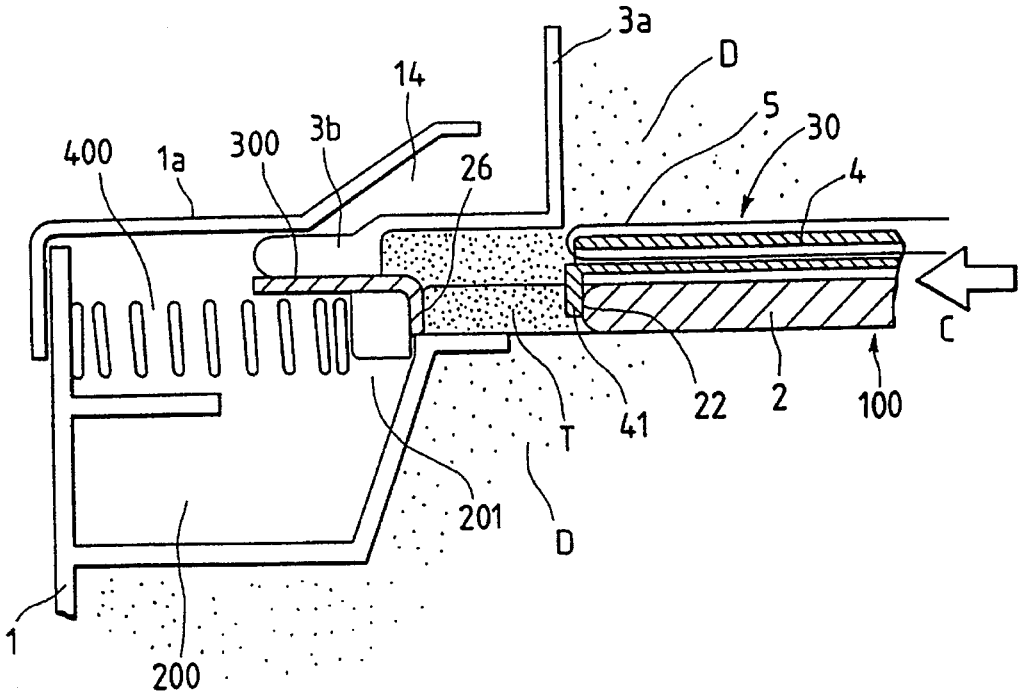
Figure 17:
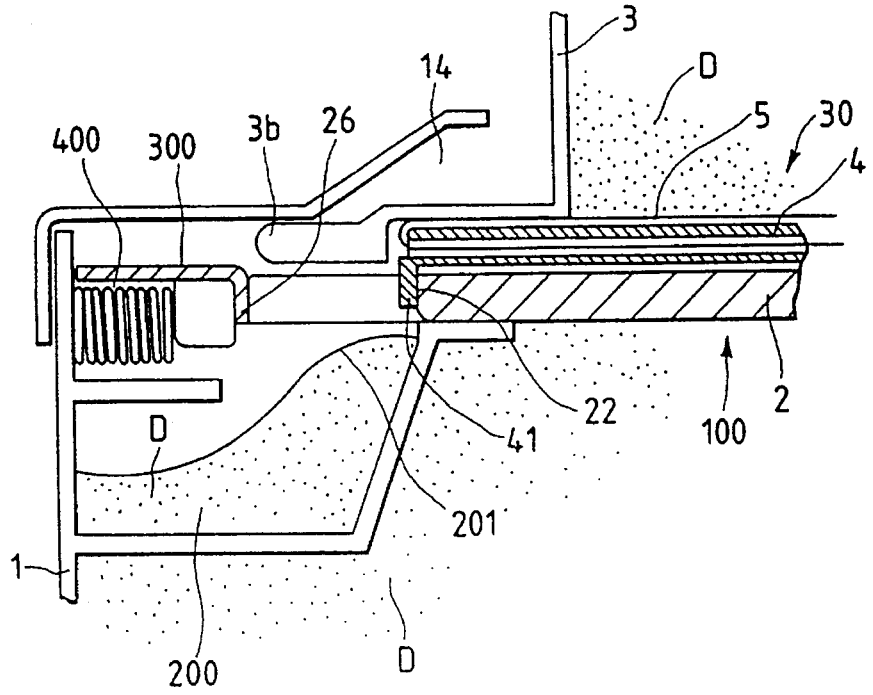

As shown in FIG. 16, immediately before the supply opening 30 of the developer replenishing container **3*a* is completely closed by the slide lid 4, the developer D has nowhere to go and is pressed together at the portion T, thus making the further closing movement of the lid 4 difficult. At this point, the end portion 26 (in the closing direction C) of the lid 2 starts to engage with the lid 300 to forcibly open the latter in opposition to the biasing force of the elastic member 400, with the result that, as shown in FIG. 17, the excessive developer at the portion T is pushed into the buffer chamber 200 through the opening 201 by the urging force of the lids 2, 4, thus ensuring the complete closing of the lid 4**.

Incidentally, in the illustrated embodiment, while the lid 300 was opened by urging it by the lid 2, a left extension may be formed on the lid 4 to open the lid 300 by urging the latter by the extension.

A further embodiment is shown in FIGS. 18 to 21. In this embodiment, a further opening 202 is formed in a bottom of the buffer chamber 200 to communicate with the interior of the developer receiving container 1.

Figure 18:
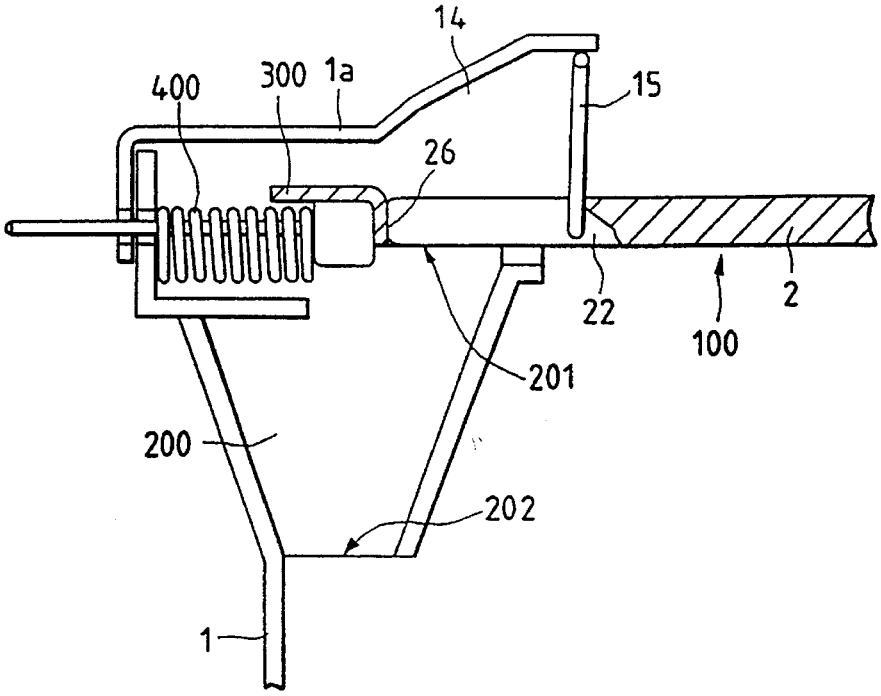
FIGS. 18, 19, 20 and 21 are sectional views showing another example of a buffer chamber.
Figure 19:
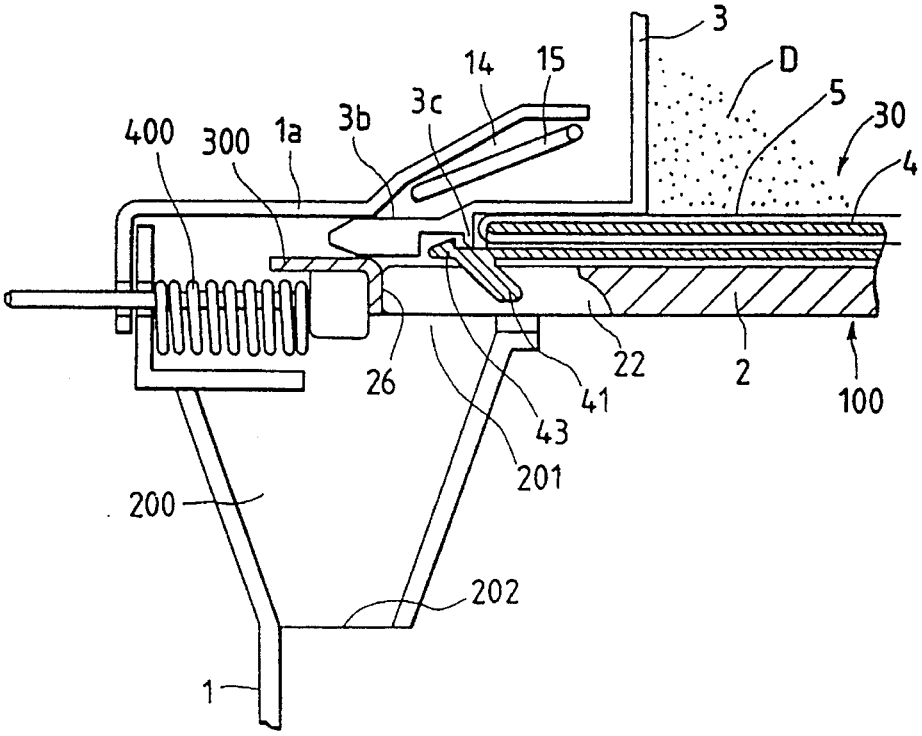

In FIG. 18, the buffer chamber 200 has the bottom opening 202. Further, in order to prevent the natural scattering of the developer from the buffer chamber 200 through the entrance (for the protruded portion **3*b* of the cartridge) of the recessed portion 14 of the container 1, an auxiliary lid 15 is pivotally mounted at the entrance. In a condition that the cartridge 3 is not mounted on the developer receiving container 1, the lid 15 is abutted against the end face 22 of the lid 2 by its own weight or by a coil spring and the like to close the entrance. The developer replenishing cartridge 3 is mounted on the developer receiving apparatus while opening the lid 15 by the protruded portion 3*b*, as shown in FIG. 19**.

Figure 20:
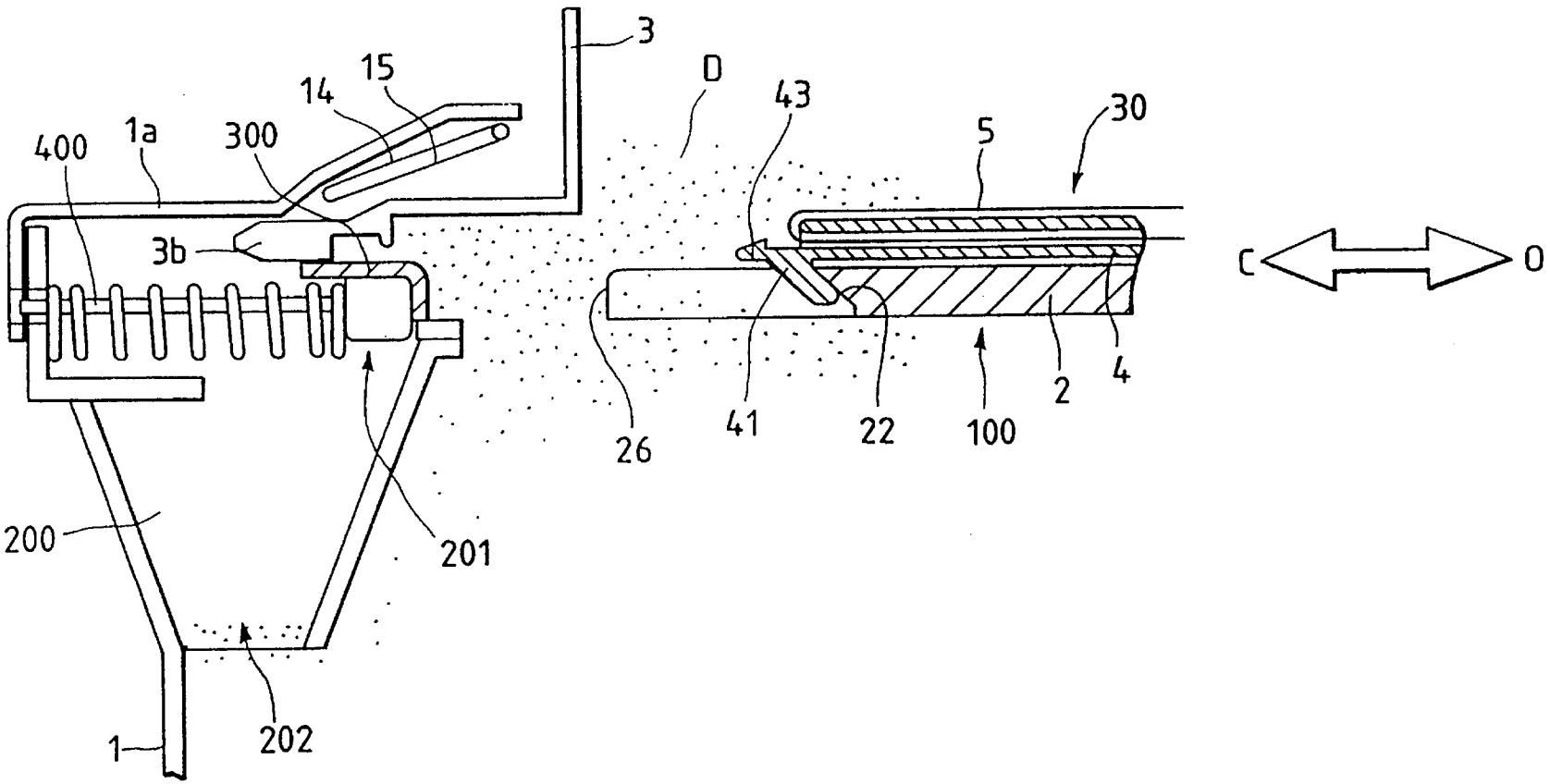

As in the previous embodiment, the lid 300 can be forcibly opened by the lid 2. However, when the developer is being replenished, the lid 300 closes the opening 201 of the buffer chamber 200 via the biasing force of the spring or elastic member 400, as shown in FIG. 20. The replenishment of the developer into the developer receiving container 1 is effected in the same manner as the previous embodiment. The bottom opening 202 has a dimension so that the buffer chamber 200 is filled with the developer from the container 1 through the opening 202 during the replenishment of the developer.

By the way, the end face 22 of the lid 2 has a convex wedged shape, and the projection 41 of the lid 4 includes an inner surface (to be engaged by the end face 22) having a complementary concave wedged shape. With this arrangement, since the inner surface of the projection 41 which is adapted to be engaged by the end face 22 of the lid 2 is tapered in the slide closing direction C, when the lid 2 is forcibly closed, the end face 22 thereof is closely contacted with the projection 41 of the lid 4, thus effectively preventing the developer from entering between the lids to avoid the contamination of the lits. Further, the free end of the lid 4 has a wedged configuration defined by the projection 41 and an additional projection 43, so that, when the lids 2, 4 are closed, the lids can easily push the developer aside.

Further, the movement of the seal sheet 5 aids to reduce the resistance between the developer and the lid 4 when the lids 2, 4 are being closed while pushing the developer aside.

As the further closing movement of the lids 2, 4 continues, immediately before the supply opening 30 of the developer replenishing cartridge 3 is completely closed by the lid 4, the lid 300 is forcibly opened by the end portion 26 of the lid 2, with the result that the excessive developer is pushed into the buffer chamber 200. Consequently, the opening 30 can be completely closed by the lid 4, as shown in FIG. 21.

Figure 21:
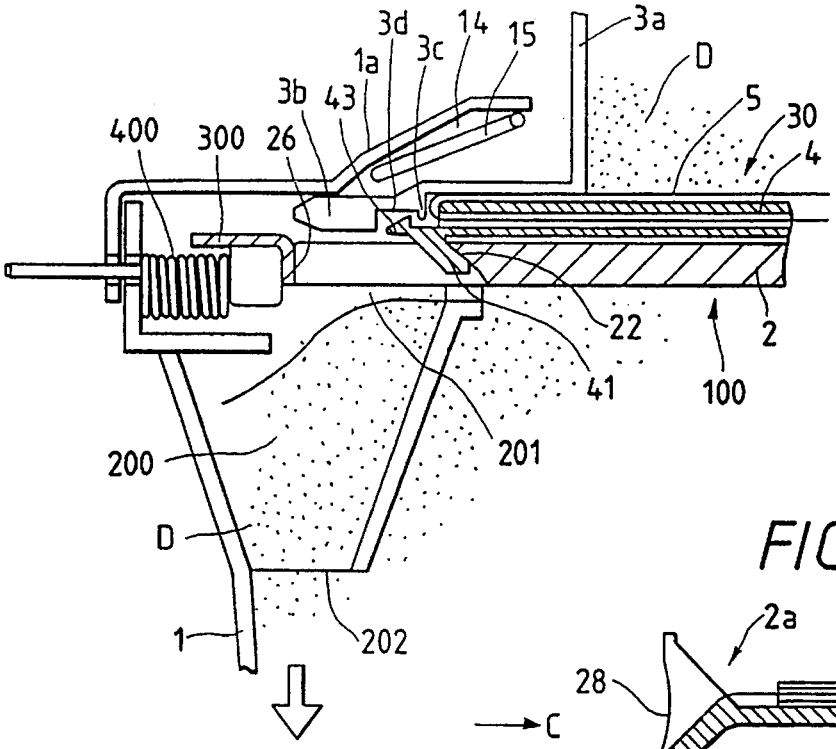

Further, as shown in FIG. 21, when the lid 4 is completely closed, the projection 43 of the lid 4 is fitted into a recess **3*d* formed in the flange portion of the cartridge container. Accordingly, after the cartridge 3 is dismounted from the developer receiving container 1, for example, even when the operator grips the protruded portion of the container 3*a* to suspend the container 3*a* laterally, since the projection 43 of the lid 4 is caught by a projection 3*c* defining the recess 3*d* of the container 3*a*, it is possible to prevent the lid 4 from sliding down or dropping out of the container 3*a*** by its own weight.

Incidentally, when the lid 4 is being opened or closed by the operator's manipulation, since the projection 43 can be elastically deformed downwardly by the abutment against the projection **3*c* to easily override the latter due to the elasticity of the lid 4 made of synthetic resin, the opening and closing movement of the lid is not obstructed. Incidentally, in the illustrated embodiment, while the projection 43 of the lid 4 was fitted into the recess 3*d* of the container 3*a*, a recess for receiving the projection 3*c* of the container 3*a* may be formed in the lid 4**.

When the developer in the developer receiving container 1 is used up and the developer in the container 1 leaves from the bottom opening 202, the developer entered into the buffer chamber 200 is sent to the container 1 to be used. Thus, the function or ability of the buffer chamber does not depend upon the volume of the buffer chamber, and, therefore, the buffer chamber can be used repeatedly.

Figure 22:
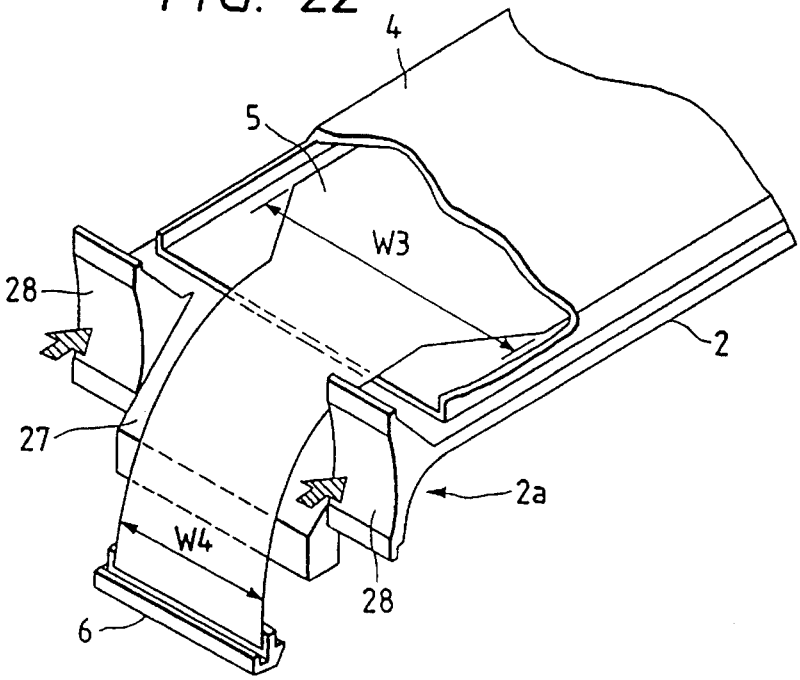
FIG. 22 is a perspective view for explaining a width of the seal sheet.

By the way, as shown in FIG. 22, the seal sheet 5 has a width W3 wider than a width of the supply opening 30 at a sheet section where it is adhered to the edge surface defining the opening 30 of the developer replenishing container 3*a*, and a width W4 narrower than the width W4 at a sheet section where it is drawn from the slide lid 4. The width W4 of the seal sheet is sufficiently narrow to permit the sheet to pass between two first grip portions 28 spaced apart in a direction perpendicular to the sliding direction of the lid 2, so that, when the lid 2 is being closed, the sheet 5 can be retracted into the lid 4 through between the first grip portions 28 of the lid 2. In this case, the operator may merely push the first grip portions 28 of the grip 2*a* in a direction shown by the arrows by his hand.

Figure 23:
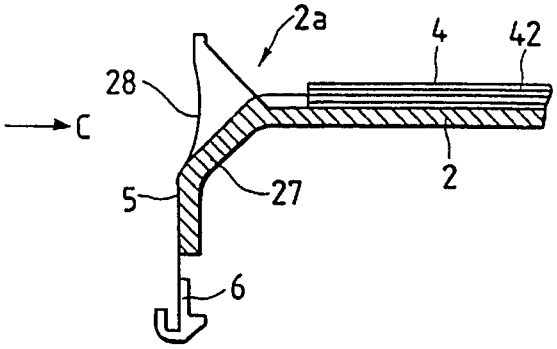
FIG. 23 is a sectional view for explaining a configuration of a gripper.

Further, a second grip portion 27 is formed on the grip 2*a* between the first grip portions 28. The grip portion 27 has an inclined surface against which the depended seal sheet 5 is slidably contacted. The inclined surface is positioned below the first grip portions (pushing grip portions) 28 (see FIG. 23). Since the seal sheet 5 stripped during the developer replenishing operation is retracted into the developer replenishing cartridge via the inclined surface lower than the first pushing grip portions 28 of the lid 2 as the lid 2 is forcibly closed, the operability of the lid closing movement is improved. Incidentally, the operator may pull out the lid 2 by pulling the second grip portion 27.

What is claimed is:

1. A developer replenishing mechanism, comprising:

a developer receiving apparatus including a developer receiving container having a developer passing opening, a lid member for opening and closing said developer passing opening, a movable locking member, and an elastic biasing means; and a developer replenishing cartridge mountable on said developer receiving apparatus, including a developer replenishing container containing therein developer and having a developer supply opening, a slide lid member for opening and closing said developer supply opening, a locking member displacing portion for acting on said locking member to displace said locking member when said developer replenishing cartridge is shifted to be mounted on said developer receiving apparatus at a predetermined position, a lock engagement portion by which said locking member is engaged after said locking member is displaced by said locking member displacing portion and a biasing force receiving portion for receiving a biasing force of said elastic biasing means by engaging by said elastic biasing means;

wherein said developer replenishing cartridge is shifted from said predetermined position by the biasing force of said elastic biasing means via said biasing force receiving portion on which said biasing force acts, when said locking member is released from said lock engagement portion.

2. A mechanism according to claim 1, wherein said lid member of said developer receiving apparatus acts on said locking member to release said locking member from said lock engagement portion when said developer passing opening is closed by said lid member.

3. A mechanism according to claim 1 or 2, wherein said slide lid member of said developer replenishing cartridge is shifted to close said developer supply opening by engaging by said lid member of said developer receiving apparatus when said lid member is shifted in a direction to close said developer passing opening.

4. A developer replenishing cartridge mountable on a developer receiving apparatus having a developer passing opening, a lid member for opening and closing said opening, a movable locking member, and an elastic biasing means, comprising:

a developer replenishing container for containing therein developer and having a developer supply opening;

a slide lid member for opening and closing said developer supply opening;

a locking member displacing portion for acting on said locking member to displace said locking member when said developer replenishing cartridge is shifted to be mounted on said developer receiving apparatus at a predetermined position;

a lock engagement portion by which said locking member is engaged after said locking member is displaced by said locking member displacing portion; and a biasing force receiving portion for receiving a biasing force of said elastic biasing means by engaging by said elastic biasing means;

wherein said developer replenishing cartridge is shifted from said predetermined position by the biasing force of said elastic biasing means via said biasing force receiving portion on which said biasing force acts, when said locking member is released from said lock engagement portion.

5. A developer replenishing cartridge according to claim 4, wherein said slide lid member has an engagement portion capable of receiving a shifting force of said lid member of said developer receiving apparatus by engaging by said lid member when said lid member is shifted in a direction to close said developer passing opening, so that said slide lid member is shifted to close to said developer supply opening by the shifting force of said lid member of said developer receiving apparatus.

6. A developer receiving apparatus on which a developer replenishing cartridge is mountable, comprising:

a developer receiving container having a developer passing opening;

a movable lid member adapted to open said opening by shifting in a first direction and to close by shifting in a second direction opposite to said first direction;

a first locking member for locking said lid member at a position where said lid member closes said opening, said first locking member being unlocked in synchronous with a mounting movement of said developer replenishing cartridge at a predetermined position;

a second locking member for locking said developer replenishing cartridge at said predetermined position in synchronous with the mounting movement of said developer replenishing cartridge at said predetermined position, said second locking member being unlocked by further shifting said lid member in said second direction from a position where said lid member is locked by said first locking member; and a biasing means for applying an elastic biasing force to said lid member positioned at a position where said lid member unlocks said second locking member;

wherein said lid member is locked by said first locking member after said lid member is shifted in said first direction from the position where said lid member unlocks said second locking member, by said elastic biasing force.

* * * * *

UNITED STATES PATENT AND TRADEMARK OFFICE

CERTIFICATE OF CORRECTION

PATENT NO. : 5,520,229

DATED : May 28, 1996

INVENTOR(S) : YOSHIHIKO YAMADA

It is certified that error appears in the above-indentified patent and that said Letters Patent is hereby corrected as shown below:

ON THE COVER PAGE

[56] References Cited

FOREIGN PATENT DOCUMENTS

"1223483" should read --1-223483--; and
"3102371" should read --3-102371--.

COLUMN 1

Line 35, "cartirdge" should read --cartridge--.
Line 36, "if do" should read --in doing--.
Line 60, "do" should read --done--.

COLUMN 5

Line 33, "an" should read --a--.
Line 62, "is" should read --are--.

COLUMN 6

Line 10, "teared" should read --torn--.

COLUMN 8

Line 58, "has" should read --have--.

UNITED STATES PATENT AND TRADEMARK OFFICE

CERTIFICATE OF CORRECTION

PATENT NO. : 5,520,229 Page 2 of 2

DATED : May 28, 1996

INVENTOR(S) : YOSHIHIKO YAMADA

It is certified that error appears in the above-indentified patent and that said Letters Patent is hereby corrected as shown below:

COLUMN 12

Line 30, "lits." should read --lids.--.

COLUMN 14

Line 35, "to said" should read --said--.
Line 48, "nous" should read --nism--.
Line 52, "synchronous" should read --synchronism--.

Signed and Sealed this

Twenty-second Day of October, 1996

Bruce Lehman

*Attest:*

BRUCE LEHMAN

*Attesting Officer*

*Commissioner of Patents and Trademarks*